US012137735B2

(12) United States Patent
Lee et al.

(10) Patent No.: US 12,137,735 B2
(45) Date of Patent: Nov. 12, 2024

(54) AEROSOL DELIVERING DEVICE AND AEROSOL GENERATING DEVICE INCLUDING THE SAME

(71) Applicant: KT&G CORPORATION, Daejeon (KR)

(72) Inventors: Jong Sub Lee, Gyeonggi-do (KR); Min Kyu Kim, Seoul (KR); Won Kyeong Lee, Gyeonggi-do (KR); Byung Sung Cho, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 423 days.

(21) Appl. No.: 17/613,835

(22) PCT Filed: Sep. 1, 2021

(86) PCT No.: PCT/KR2021/011743
§ 371 (c)(1),
(2) Date: Nov. 23, 2021

(87) PCT Pub. No.: WO2022/050677
PCT Pub. Date: Mar. 10, 2022

(65) Prior Publication Data

US 2023/0143680 A1 May 11, 2023

(30) Foreign Application Priority Data

Sep. 2, 2020 (KR) ..... 10-2020-0111680
Jun. 3, 2021 (KR) ..... 10-2021-0072396

(51) Int. Cl.
*A24F 40/30* (2020.01)
*A24F 40/42* (2020.01)
(Continued)

(52) U.S. Cl.
CPC ..... *A24F 40/30* (2020.01); *A24F 40/42* (2020.01); *A24F 40/46* (2020.01); *A24F 40/485* (2020.01); *A24F 40/51* (2020.01)

(58) Field of Classification Search
None
See application file for complete search history.

(56) References Cited

U.S. PATENT DOCUMENTS 10,743,583 B2 8/2020 Reevell
2017/0238611 A1* 8/2017 Buchberger ..... A24F 40/485
(Continued)

FOREIGN PATENT DOCUMENTS

CN 106659250 A 5/2017
CN 109890232 A 6/2019
(Continued)

OTHER PUBLICATIONS

Japanese Office Action dated Jan. 17, 2023 in Japanese Application No. 2022-500782.
(Continued)

*Primary Examiner* — Philip Y Louie
*Assistant Examiner* — John M Martin
(74) *Attorney, Agent, or Firm* — Sughrue Mion, PLLC

(57) ABSTRACT

An aerosol generating device includes an aerosol delivering device including a first cartridge in which a first material for generating an aerosol is accommodated, and a second cartridge rotatably coupled to the first cartridge, configured to accommodate a second material, and arranged such that an aerosol generated from the first material passes through the second material, and an atomizer that is connected to the first cartridge and configured to generate the aerosol by atomizing the first material and deliver the aerosol to the second cartridge.

15 Claims, 17 Drawing Sheets

(51) Int. Cl.

| | |
|---|---|
| ***A24F 40/46*** | (2020.01) |
| ***A24F 40/485*** | (2020.01) |
| ***A24F 40/51*** | (2020.01) |

(56) References Cited

U.S. PATENT DOCUMENTS

| | | | | |
|---|---|---|---|---|
| 2018/0029782 | A1 | 2/2018 | Zuber et al. | |
| 2018/0295884 | A1* | 10/2018 | Borkovec | A24F 40/48 |
| 2019/0230993 | A1 | 8/2019 | Buchberger | |
| 2019/0289909 | A1 | 9/2019 | Hejazi | |
| 2019/0307168 | A1 | 10/2019 | Zhao et al. | |
| 2019/0307173 | A1 | 10/2019 | Qui | |
| 2019/0328044 | A1 | 10/2019 | Qiu | |
| 2019/0373951 | A1 | 12/2019 | Wu et al. | |
| 2020/0120977 | A1 | 4/2020 | Bless et al. | |
| 2020/0345066 | A1 | 11/2020 | Kim et al. | |
| 2020/0367554 | A1 | 11/2020 | Reevell | |
| 2020/0383380 | A1* | 12/2020 | Spencer | A24F 40/50 |
| 2022/0087311 | A1 | 3/2022 | Han et al. | |

FOREIGN PATENT DOCUMENTS

| | | | |
|---|---|---|---|
| CN | 210581021 | U | 5/2020 |
| CN | 111329110 | A | 6/2020 |
| EP | 2 989 912 | A1 | 3/2016 |
| JP | 2019-534026 | A | 11/2019 |
| JP | 2020-516260 | A | 6/2020 |
| KR | 10-2019-0028718 | A | 3/2019 |
| KR | 10-2019-0078564 | A | 7/2019 |
| WO | 2015/052192 | A1 | 4/2015 |
| WO | 2018/086999 | A1 | 5/2018 |
| WO | 2019/110669 | A1 | 6/2019 |
| WO | 2020/101213 | A1 | 5/2020 |

OTHER PUBLICATIONS

Extended European Search Report dated Jul. 7, 2022 in European Application No. 21798928.4.

Chinese Office Action dated Apr. 19, 2023 in Chinese Application No. 202180004286.9.

International Search Reported dated Dec. 15, 2021 in Application No. PCT/KR2021/011743.

* cited by examiner

AEROSOL DELIVERING DEVICE AND AEROSOL GENERATING DEVICE INCLUDING THE SAME

CROSS REFERENCE TO RELATED APPLICATIONS

This application is a National Stage of International Application No. PCT/KR2021/011743 filed Sep. 1, 2021, claiming priority based on Korean Patent Application No. 10-2020-0111680 filed Sep. 2, 2020 and Korean Patent Application No. 10-2021-0072396 filed Jun. 3, 2021.

TECHNICAL FIELD

One or more embodiments relate to an aerosol delivering device and an aerosol generating device including the same, and more particularly, to an aerosol delivering device in which some of a plurality of cartridges are installed, and an aerosol generating device including the same.

BACKGROUND ART

Recently, the demand for alternative methods to overcome the shortcomings of general aerosol generating articles has increased. For example, there is an increasing demand for a method of generating aerosol with a non-combustion method.

DISCLOSURE OF INVENTION

Technical Problem

There is a demand for an aerosol generating device than can be easily used and carried and can generate an aerosol of good quality.

Solution to Problem

One or more embodiments of the present disclosure provide an aerosol generating device that may solve the above described problems.

One or more embodiments of the present disclosure include an aerosol generating device that may be easily used and carried. One or more embodiments also include an aerosol generating device that may generate an aerosol of good quality capable of satisfying various needs of consumers.

Technical goals to be achieved by embodiments of the present disclosure are not limited to the above-described goals, and goals that are not mentioned will be clearly understood by one of ordinary skill in the art from the present specification and the accompanying drawings.

According to an aspect of the present disclosure, an aerosol generating device includes an aerosol delivering device including a first cartridge in which a first material for generating an aerosol is accommodated, and a second cartridge which is arranged outside or inside the first cartridge to be rotated with respect to the first cartridge and in which a second material for passing an aerosol generated from the first material is accommodated, and an atomizer that is connected to the first cartridge and atomizes the first material to generate an aerosol and to deliver the aerosol to the second cartridge.

According to another aspect of the present disclosure, an aerosol delivering device includes a first cartridge in which a first material for generating an aerosol is accommodated, and a second cartridge which is arranged outside or inside the first cartridge to be rotated with respect to the first cartridge and in which a second material for passing the aerosol generated from the first material is accommodated.

Advantageous Effects of Invention

An aerosol generating device according to one or more embodiments may be convenient to carry and use because a first cartridge for accommodating a first material and a second cartridge for accommodating a second material are integrated with each other in a single device.

In addition, the chambers of the second cartridge may contain different types of second materials. A user may select one of the chambers to select a desired second material, thereby freely enjoying an aerosol having various flavors according to the user's preference.

In addition, because a usage chamber currently in use may be identified based on a signal of a position sensor, reliable and stable control of the aerosol generating device is possible. Also, information about the usage chamber may be provided to the user so that the convenience of use may be increased.

In addition, even if the first cartridge of the aerosol generating device is designed to contain a large amount of the first material, the relative positions of the first cartridge and the second cartridge may be automatically changed by a driving device to select the chamber used for supplying the aerosol or to adjust the position of the chamber to a new position, the second material may be replaced with a new second material without replacing the second cartridge including the second material.

In addition, because a distance between the second cartridge and an atomizer in the aerosol generating device is reduced, an aerosol generated in the atomizer may be quickly and directly delivered to the second cartridge so that the aerosol generating device may provide an aerosol of good quality to the user.

BEST MODE FOR CARRYING OUT THE INVENTION

Figure 1:
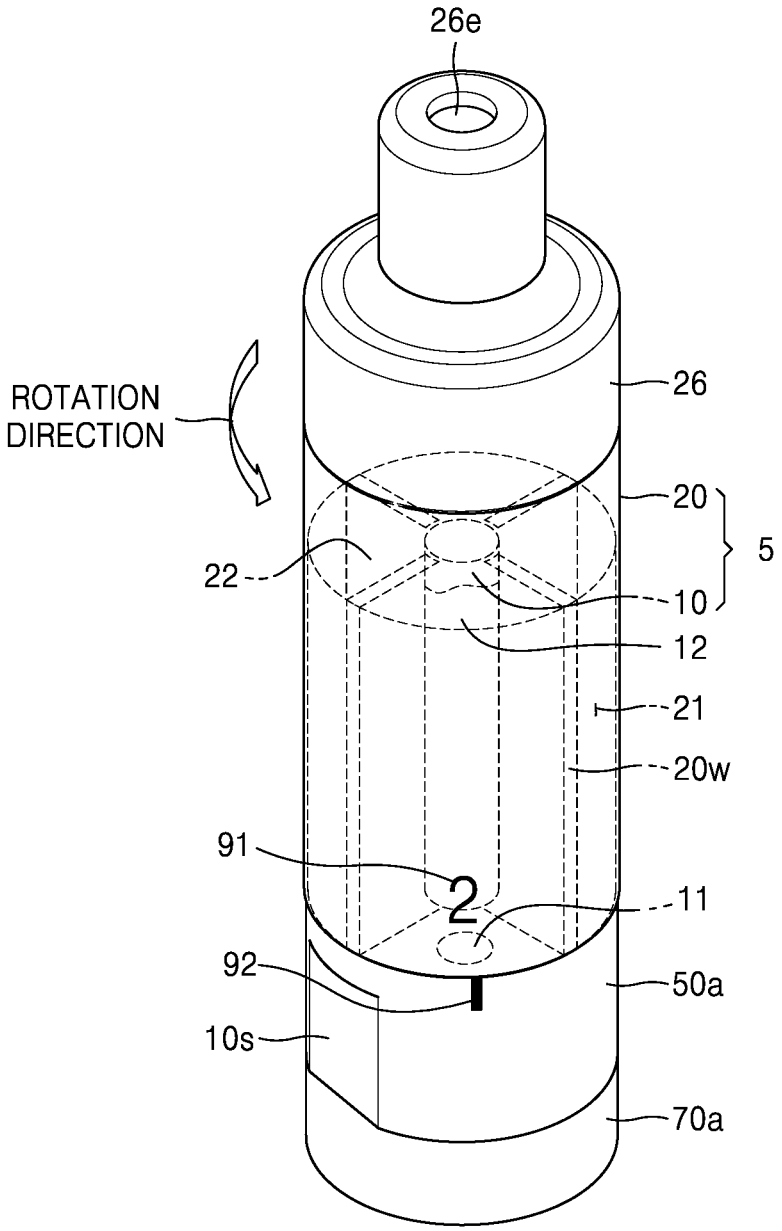
FIG. 1 is a perspective view of an aerosol generating device according to an embodiment.

An aerosol generating device according to an embodiment may include an aerosol delivering device including a first cartridge configured to accommodate a first material for generating an aerosol; and a second cartridge rotatably coupled to the first cartridge, configured to accommodate a second material, and arranged such that the aerosol generated from the first material passes through the second material; and an atomizer connected to the first cartridge and configured to generate the aerosol by atomizing the first material and deliver the aerosol to the second cartridge.

The second cartridge may include a single chamber that extends in a rotation direction of the second cartridge and accommodates the second material The second cartridge may include a plurality of chambers sequentially arranged in a rotation direction of the second cartridge to accommodate the second material.

The aerosol generating device may further include a driving device configured to rotate the second cartridge, wherein the atomizer includes a delivery hole through which the aerosol generated from the first material is delivered to the second cartridge, and the second cartridge may be rotated by the driving device so that the aerosol delivered from the delivery hole passes through at least one of the chambers of the second cartridge.

A relative position of the second cartridge with respect to the first cartridge may be changed so that a position of one of the chambers is aligned with a position of the delivery hole.

A relative position of the second cartridge with respect to the first cartridge may be changed so that adjacent chambers from among the chambers simultaneously overlap the delivery hole.

The atomizer may be detachably coupled to the aerosol delivering device and atomizes the first material supplied from the first cartridge to generate an aerosol, and the atomizer may include a delivery hole through which the aerosol is delivered to the second cartridge.

The aerosol generating device may further include a driving device configured to rotate the second cartridge with respect to the first cartridge and a controller configured to change a rotation position of the second cartridge with respect to the first cartridge.

The aerosol generating device may further include a position sensor configured to detect the relative position of the second cartridge with respect to the first cartridge.

The aerosol generating device may further include a handle that is operable by a user so as to change a relative position of the second cartridge with respect to the first cartridge.

The atomizer may include a delivery body of a porous material absorbing and holding the first material of the first cartridge, and a heater printed on the delivery body or formed integrally with the delivery body to generate heat by electricity applied from the outside.

The second cartridge may be arranged outside the first cartridge, the atomizer may deliver an aerosol generated from the first material to an outer surface of the first cartridge, and the aerosol generated from the first material of the first cartridge may move along at least a portion of the outer surface of the first material.

An aerosol delivering device according to another embodiment may include a first cartridge in which a first material for generating an aerosol is accommodated, and a second cartridge rotatably coupled to the first cartridge, configured to accommodate a second material, and arranged such that the aerosol generated from the first material passes through the second material.

The second cartridge may be arranged outside the first cartridge to surround the first cartridge, at least a portion of the first cartridge may include a transparent material so that the remaining amount of the first material is viewable through the transparent material, and the second cartridge may include a transparent window through which the transparent material of the first cartridge is viewable from outside of the second cartridge.

MODE FOR THE INVENTION

With respect to the terms used to describe the various embodiments of the present disclosure, general terms which are currently and widely used are selected in consideration of functions of structural elements in the various embodiments of the present disclosure. However, the meaning of the terms can be provided according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meaning of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

If one component or layer is mentioned to be "over," "above," "connected to," or "combined with" another component or layer, the one component or layer is arranged to be over, above, connected to, or combined with the other component or layer with or without an intervening component(s) or layer(s). In contrast, if one component or layer is mentioned to be "directly over," "directly above," "directly connected to," or "directly combined with" another component or layer, there is no additional components or layers between the components or layers. In the disclosure, the same reference numbers may indicate the same components.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

In addition, terms used in the present specification are for describing the embodiments and are not intended to limit the embodiments. In the present specification, the singular form also includes the plurality form unless specifically stated in the phrase.

While such terms as "first," "second," etc., may be used to describe various components, such components must not be limited to the above terms. The above terms are used only to distinguish one component from another.

Throughout the specification, the "longitudinal direction" of a component may be a direction in which the component extends along an axis in one direction of the component, wherein the axis in one direction of the component extends longer than an axis in the other direction of the component crossing the axis in one direction of the component.

Figure 2:
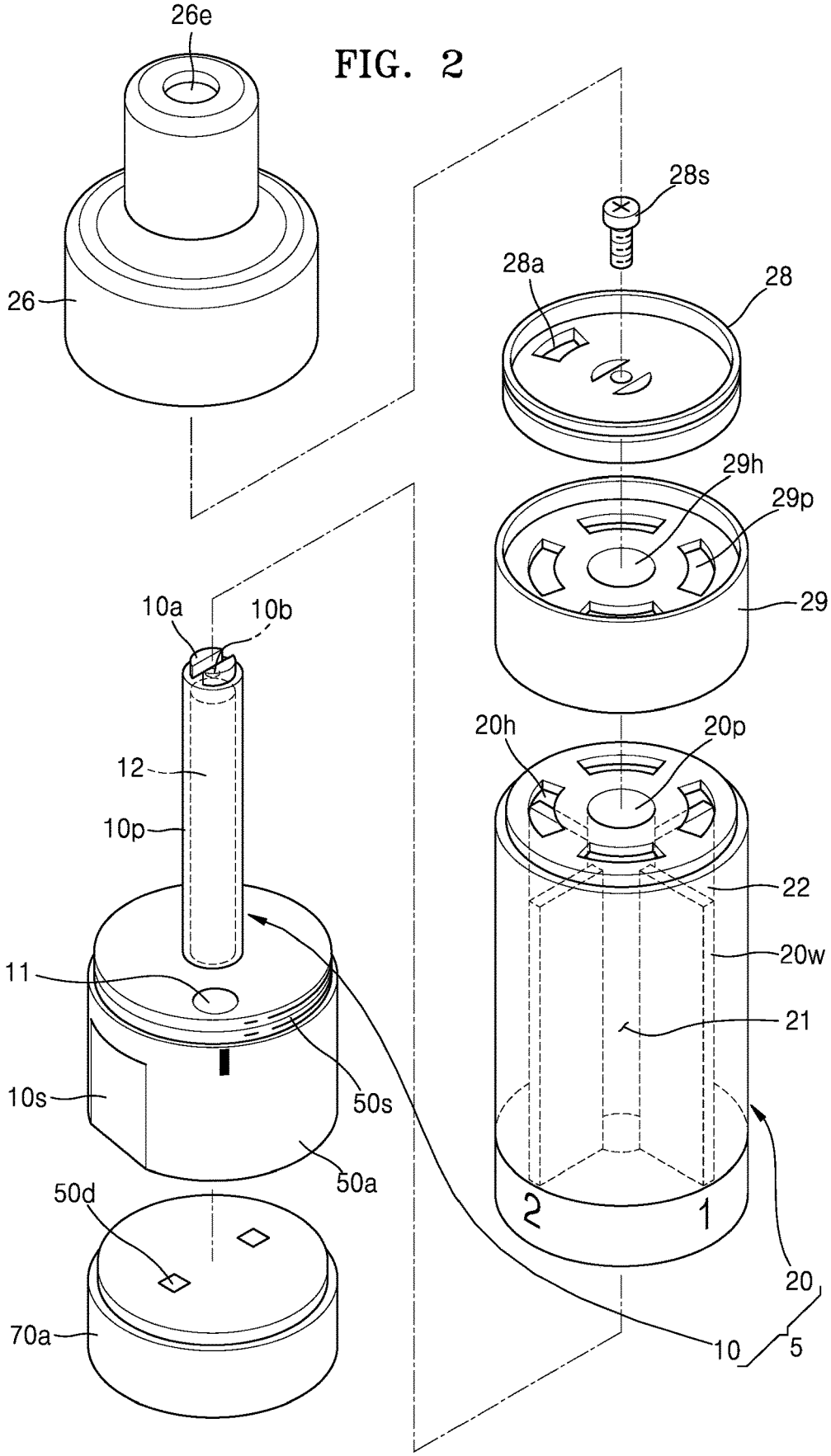
FIG. 2 is an exploded view schematically illustrating a coupling relationship between components of the aerosol generating device according to the embodiment shown in FIG. 1.
Figure 3:
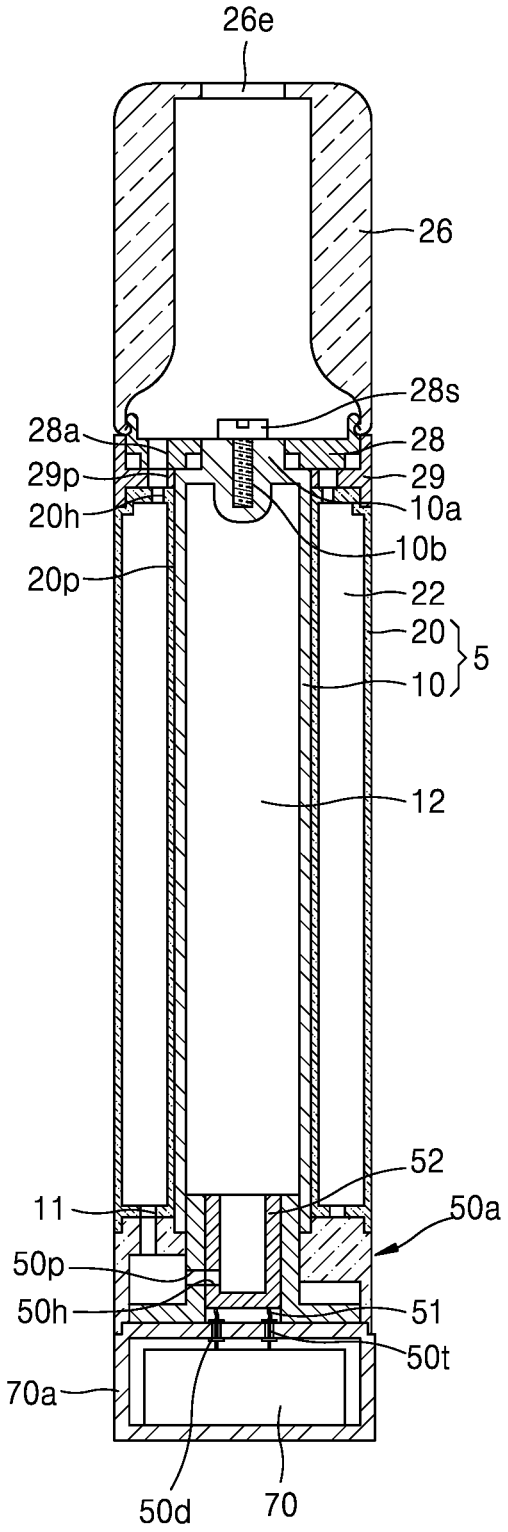
FIG. 3 is a longitudinal cross-sectional view of the aerosol generating device according to the embodiment shown in FIG. 1.

FIG. 1 is a perspective view of an aerosol generating device according to an embodiment, FIG. 2 is an exploded view schematically illustrating a coupling relationship between components of the aerosol generating device according to the embodiment shown in FIG. 1, and FIG. 3 is a longitudinal cross-sectional view of the aerosol generating device according to the embodiment shown in FIG. 1.

The aerosol generating device according to the embodiment shown in FIGS. 1 through 3 may include an aerosol delivering device 5 for delivering an aerosol to a user, and an atomizer 50*a* connected to the aerosol delivering device 5. The aerosol generating device may further include a main body 70*a* detachably connectable to the atomizer 50*a*.

The aerosol generating device according to the embodiment shown in FIGS. 1 through 3 may supply an aerosol to the user. For example, the aerosol generating device may heat an aerosol generating material by using a heater operated with electricity, an induction magnetic field, or ultrasonic waves so as to generate an aerosol.

The aerosol delivering device 5 may deliver an aerosol generated by the atomizer 50*a*. The aerosol delivering device 5 may or may not include the atomizer 50*a*. In this regard, according to embodiments, the aerosol delivering device 5 and the atomizer 50*a* may be collectively referred to as "aerosol delivering device." The atomizer 50*a* may include a position fixing surface 10*s* which has different curvature than a cylindrical surface of the atomizer 50*a*. The position fixing surface 10*s* may perform the function of determining the position of the aerosol delivering device 5 when the aerosol delivering device 5 is coupled to the aerosol generating device.

The aerosol delivering device 5 may include a first cartridge 10 in which a first material 12 for generating the aerosol is accommodated, and a second cartridge 20 arranged outside the first cartridge 10 to be rotated with respect to the first cartridge 10.

Although the overall shape of the aerosol delivering device 5 and the aerosol generating device in the embodiment shown in FIGS. 1 through 3 is a cylindrical shape, embodiments are not limited by the shape of the aerosol delivering device 5 and the shape of the aerosol generating device. For example, a latitudinal cross-sectional shape of at least one of the aerosol delivering device 5 and the aerosol generating device may be other shapes such as a polygonal shape or an oval shape.

The first cartridge 10 and the second cartridge 20 may be coupled to each other to form the aerosol delivering device 5, and may be handled as a single part. Thus, after all the materials accommodated in the first cartridge 10 and the second cartridge 20 are exhausted, the aerosol delivering device 5 including the first cartridge 10 and the second cartridge 20 may be replaced with a new one.

Embodiments are not limited by the above-described replacement method of the aerosol delivering device 5. For example, at least one of the first cartridge 10 and the second cartridge 20 may be separated from the aerosol delivering device 5 and replaced individually.

The first cartridge 10 of the aerosol delivering device 5 may be connected to the atomizer 50*a* and may supply the first material 12 to the atomizer 50*a*. The aerosol generated from the atomizer 50*a* may be discharged toward the outer surface of the first cartridge 10 through a delivery hole 11. The aerosol discharged through the delivery hole 11 may move along the outer surface of the first cartridge 10.

Here, 'moving along the outer surface of the first cartridge 10' does not necessarily mean that the aerosol moves while coming into contact with the outer surface of the first cartridge 10. That is, the aerosol may move along the extension direction of the first cartridge 10 (i.e., upward) without contacting the first cartridge 10.

The second cartridge 20 may accommodate a second material 22 such that the aerosol discharged from the atomizer 50*a* passes through the second material 22 before being inhaled by the user. The second cartridge 20 may include a plurality of chambers 21 that are separated from each other by a barrier wall 20*w*, and the second material 22 may be accommodated in each of the plurality of chambers 21. The plurality of chambers 21 of the second cartridge 20 may be sequentially arranged in the rotation direction of the second cartridge 20.

Embodiments are not limited by the number of chambers 21 shown in FIG. 1. For example, one or two chambers 21 may be installed.

The second cartridge 20 arranged outside the first cartridge 10 may be rotated with respect to the first cartridge 10. Referring to FIG. 2, the second cartridge 20 may be coupled to a rail 50*s* formed along a circumferential edge of a top end of the atomizer 50*a* to make a rotational motion around the first cartridge 10. The first cartridge 10 may serve as a rotation shaft that supports the second cartridge 20 for the rotational motion of the second cartridge 20.

When the aerosol generating device in an assembled state as shown in FIG. 1 by hand, a user may hold the main body 70*a* of the aerosol generating device with one hand and rotate the second cartridge 20 with the other hand, so that the second cartridge 20 may be rotated around the first cartridge 10.

The aerosol generating device may include a mouthpiece 26 that is connected to an upper end of the second cartridge 20. The mouthpiece 26 includes an outlet 26*e* for discharging the aerosol which has passed through the second material 22 of the second cartridge 20 to the outside, thereby supplying the aerosol to the user.

The second cartridge 20 may include a mark 91 on an outer surface of the second cartridge 20. The mark 91 of the second cartridge 20 may be arranged at a position corresponding to each of the plurality of chambers 21 inside the second cartridge 20.

The atomizer 50*a* may include a mark 92 that may be located on an outer surface of the atomizer 50*a* and may be used as a reference position with respect to the mark 91 of the second cartridge 20. Thus, the user may rotate the second cartridge 20 with respect to the first cartridge 10 so that the mark 91 of the second cartridge 20 may coincide with the mark 92 of the atomizer 50*a* and the position of at least one of the chambers may be aligned with the position of the delivery hole 11 through which the aerosol is discharged.

Also, the user may check the positions of the mark 91 of the second cartridge 20 and the mark 92 of the atomizer 50*a* to identify a chamber through which the aerosol currently passes, among the chambers 21 of the second cartridge 20.

The first cartridge 10 may accommodate the first material 12 therein. The first material 12 may be, for example, a liquid or gel. The first material 12 may be in a liquid state and maintained in a porous material such as a sponge or cotton inside the first cartridge 10.

The first material 12 may be a liquid and may include, for example, a tobacco-containing material or a non-tobacco material including a volatile tobacco flavor component.

The first material 12 may include, for example, water, a solvent, ethanol, plant extract, spices, flavorings, or a vitamin mixture.

Examples of the spices of the first material 12 may include menthol, peppermint, spearmint, and various fruit-flavored ingredients, but are not limited thereto. The flavorings may include ingredients capable of providing various flavors or tastes to the user.

Vitamin mixtures of the first material 12 may be a mixture of at least one of vitamin A, vitamin B, vitamin C, and vitamin E, but are not limited thereto.

Also, the first material 12 may include an aerosol forming substance, such as glycerin and propylene glycol.

Referring to FIG. 2, the first cartridge 10 may have a cylindrical shape extending long in a longitudinal direction. The first cartridge 10 may include a storage 10*p* for accommodating the first material 12 therein, and the atomizer 50*a* installed at a lower end of the storage 10*p*. The main body 70*a* having an electrical terminal 50*d* exposed upwards may be coupled to a lower end of the atomizer 50*a*.

The second cartridge 20 may be coupled to the first cartridge 10 in a rotatable manner. A cylindrical wall 20*p* that extends in the longitudinal direction and corresponds to the outer shape of the first cartridge 10 may be formed inside the second cartridge 20. When the first cartridge 10 is inserted into the cylindrical wall 20*p* of the second cartridge 20, coupling of the first cartridge 10 to the second cartridge 20 may be completed, and the second cartridge 20 may be rotated with respect to the first cartridge 10.

A plurality of chambers 21 that are separated by the barrier wall 20*w* and accommodate the second material 22 may be formed inside the second cartridge 20. An upper hole 20*h* through which each of the chambers 21 for accommodating the second material 22 is opened upwards, may be formed in a top end of the second cartridge 20.

An intermediate cover 29 may be coupled to an upper portion of the second cartridge 20 in a state where the second cartridge 20 is coupled to the outside of the first cartridge 10. The intermediate cover 29 may include a connection hole 29*p* formed at a position corresponding to the upper hole 20*h* of the second cartridge 20, and a central hole 29*h* formed at a center of the intermediate cover 29 such that an upper flange 10*a* of the first cartridge 10 passes through the central hole 29*h*. The intermediate cover 29 may make a rotational motion together with the second cartridge 20, so that the coupled state of the second cartridge 20 and the first cartridge 10 may be stably maintained during rotation of the second cartridge 20.

When the second cartridge 20 and the intermediate cover 29 are coupled to the first cartridge 10, the upper flange 10*a* of the first cartridge 10 may protrude past the upper side of the intermediate cover 29. A fastening screw 28*s* may penetrate the upper cover 28 and may be coupled to a screw hole 10*b* of the upper flange 10*a* of the first cartridge 10, so that the upper cover 28 may be coupled to the upper flange 10*a* of the first cartridge 10.

While the intermediate cover 29 and the second cartridge 20 are rotated with respect to the first cartridge 10, the upper cover 28 may not be rotated but may be maintained coupled to the upper flange 10*a* of the first cartridge 10. Accordingly, while the second cartridge 20 is rotated with respect to the first cartridge 10, the second cartridge 20 may not deviate upward from the first cartridge 10 and the coupled state of the second cartridge 20 and the first cartridge 10 may be stably maintained.

The upper cover 28 may include a discharge hole 28*a* through which the aerosol passing through the second material 22 of the second cartridge 20 is delivered to the mouthpiece 26.

Referring to FIG. 3, a controller 70 may be installed inside the main body 70*a*. The controller 70 may include a battery for supplying power to the atomizer 50*a* and a control chip or control circuit board for controlling the operation of the atomizer 50*a*.

The atomizer 50*a* may include a heater 52 that absorbs the first material 12 from the first cartridge 10, maintains the absorbed first material 12 and generates heat by electricity supplied from the outside, thereby heating the first material 12 to generate an aerosol. The heater 52 may be electrically connected to the electrical terminal 50*d* of the main body 70*a* through a wiring 51 and a connection terminal 50*t*.

The atomizer 50*a* may generate an aerosol by converting a phase of the first material 12 (i.e., an aerosol generating material) into a gaseous phase. The aerosol may refer to a gas in which vaporized particles generated from the aerosol generating material are mixed with air. The aerosol generated from the atomizer 50*a* may sequentially pass through a discharge hole 50*h* (see FIG. 4), a delivery passage 50*p*, and the delivery hole 11 and may be discharged toward the outer surface of the first cartridge 10.

Figure 4:
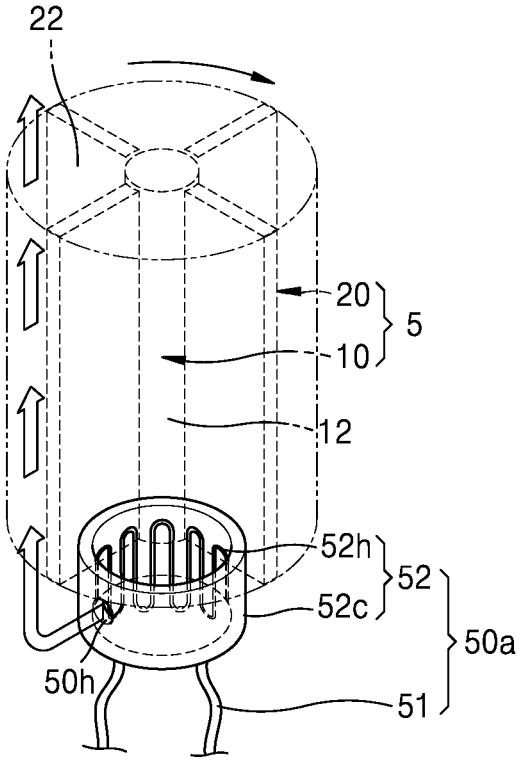
FIG. 4 is a perspective view schematically illustrating some components of the aerosol generating device according to the embodiment shown in FIG. 1.

FIG. 4 is a perspective view schematically illustrating some components of the aerosol generating device according to the embodiment shown in FIG. 1. In particular, FIG. 4 illustrates a detailed example of the heater 52 that may be used in the aerosol generating device.

The heater 52 of the atomizer 50*a* may include a delivery body 52*c* made of a porous material that may absorb and accommodate (i.e., hold) the first material 12 of the first cartridge 10, and a heater wiring 52*h* formed integrally with the delivery body 52*c* or printed on the surface of the delivery body 52*c*.

The porous material may include, for example, a porous ceramic material, a porous plastic material, a porous glass fiber material, or the like.

The delivery body 52*c* may have a cup shape that may accommodate the first material 12 in a liquid state, as shown in FIG. 4. However, embodiments are not limited by the shape of the delivery body 52*c*. The delivery body 52*c* may have, for example, a bed structure in which left and right wall surfaces are exposed to the outside to increase a contact area with air.

A space for creating an atmosphere for generating an aerosol may be formed inside the delivery body 52*c*. The space inside the delivery body 52*c* may serve as an aerosol chamber in which an aerosol generating action occurs. The delivery body 52*c* may include a discharge hole 50*h* for discharging the aerosol generated in the aerosol chamber to the outside of the aerosol chamber by connecting the inside of the aerosol chamber to the outside. The aerosol discharged through the discharge hole 50*h* may be delivered toward the outer surface of the first cartridge 10, and the aerosol may pass through the second material 22 of the second cartridge 20 located outside the first cartridge 10 and then may be supplied to the user.

The heater wiring 52*h* may be formed in the delivery body 52*c* by printing an electric resistive heating element material along the surface of the delivery body 52*c*. Alternatively, the heater wiring 52*h* may be integrally formed with the delivery body 52*c* when the delivery body 52*c* is molded. For example, the heater wiring 52*h* and the delivery body 52*c* may be integrally molded by insert molding.

Because the wiring 51 is electrically connected to the heater wiring 52*h*, electricity may be supplied to the heater wiring 52*h* via the wiring 51.

In the above-described embodiment, the heater 52 of the atomizer 50*a* includes an electric resistive heating element, but embodiments are not limited thereto. For example. The atomizer 50*a* may generate an aerosol by an ultrasonic wave vibration method, or may generate an aerosol by an induction heating method.

Also, the heater 52 may be modified into various shapes other than the cup shape as described above. For example, the heater 52 of the atomizer 50*a* may include a wick that absorbs and holds the first material 12, and a wire-type or coil-type heating element may be wound on the wick or positioned adjacent to the wick to heat the first material 12 to generate an aerosol.

Referring to FIGS. 2 and 3, the mouthpiece 26 may be coupled to an upper portion of the second cartridge 20. The mouthpiece 26 may include the outlet 26*e* for discharging the aerosol which has passed through the second material 22 of one of the chambers 21 to the outside.

The atomizer 50*a* may include the delivery hole 11 through which the aerosol generated from the first material 12 is delivered to the outer surface of the first cartridge 10. Because the delivery hole 11 faces the second material 22 of the second cartridge 20, the aerosol discharged through the delivery hole 11 may flow upward along the outer surface of the first cartridge 10 by passing through the second material 22 of the second cartridge 20.

The aerosol that reaches the upper end of the second material 22 inside the second cartridge 20 after passing through the second material 22 may be discharged to the outside through the mouthpiece 26.

The second material 22 may be in a solid state and may be in the form of, for example, powder or granules (i.e., a collection of small-sized particles).

The second material 22 may include, for example, a tobacco-containing material including a volatile tobacco flavor component, one or more additives (e.g., flavors, a wetting agent, and/or organic acid), or a flavored material (e.g., menthol or a moisturizer). Also, the second material 22 may include plant extract, spices, flavorings, a vitamin mixture, or a mixture of these ingredients.

Examples of the spices of the second material 22 may include menthol, peppermint, spearmint, and various fruit-flavored ingredients, but are not limited thereto.

The flavorings of the second material 22 may include ingredients capable of providing various flavors or tastes to the user.

The vitamin mixture of the second material 22 may be a mixture of at least one of vitamin A, vitamin B, vitamin C, and vitamin B, but are not limited thereto.

When the aerosol delivering device 5 and the aerosol generating device including the same as described above are used, the user may rotate the second cartridge 20 with respect to the first cartridge 10 so as to adjust the rotation position of the second cartridge 20 so that the position of at least one of the chambers 21 of the second cartridge 20 may be placed in a position corresponding to the delivery hole 11 of the atomizer 50*a*.

The user may inhale the aerosol through the mouthpiece 26 in a state in which at least one of the chambers 21 of the second cartridge 20 is connected to the delivery hole 11 of the atomizer 50*a*.

An aerosol generating device including the aerosol delivering device 5 may be handled as one device in which the first cartridge 10 for accommodating the first material 12 and the second cartridge 20 for accommodating the second material 22 are integrated with each other, and thus it is convenient to carry and use the aerosol generating device.

In addition, the second cartridge 20 may be rotated to select a chamber for supplying the aerosol from among the chambers 21, so the second material 22 may be changed without replacing the second cartridge 20.

In addition, the plurality of chambers 21 of the second cartridge 20 may include different types of second materials 22. For example, the chambers 21 may include the second materials 22 having different particle sizes or different flavors. When the chambers 21 include different types of second materials 22, the user may select one of the chambers 21 containing the second material 22 of the desired flavor, thereby freely enjoying the aerosol having various flavors.

In addition, because the second cartridge 20 is located outside the first cartridge 10, a distance between the second cartridge 20 and the atomizer 50*a* in the aerosol generating device is reduced so that the aerosol generated in the atomizer 50*a* may be quickly and directly delivered to the second cartridge 20. Accordingly, the aerosol generating device and the aerosol delivering device may supply an aerosol of good quality to the user.

Figure 5:
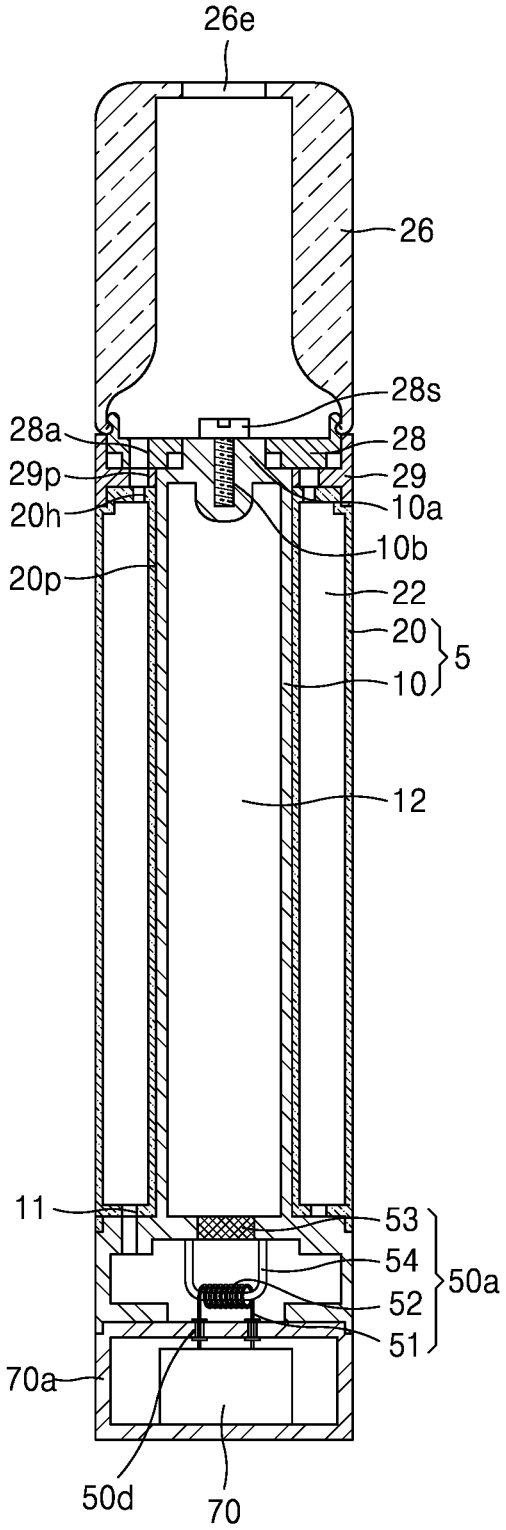
FIG. 5 is a longitudinal cross-sectional view of an aerosol generating device according to another embodiment.

FIG. 5 is a longitudinal cross-sectional view of an aerosol generating device according to another embodiment.

The configuration of the aerosol generating device according to the embodiment shown in FIG. 5 is generally similar to the configuration of the aerosol generating device according to the embodiment shown in FIG. 3, but the installation position of the atomizer 50*a* is modified. The atomizer 50*a* may be installed at a lower end of the aerosol delivering device 5 and may form a part of the aerosol delivering device 5.

The atomizer 50*a* may include an absorber 53, a wick 54, and a heater 52. The absorber 53 may absorb the first material 12 from a lower portion of the first cartridge 10 and deliver the first material 12 to the wick 54. The wick 54 connected to the absorber 53 may absorb and hold the first material 12. The heater 52 may heat the wick 54 to generate an aerosol.

The absorber 53 and the wick 54 may include, for example, a material such as cotton fiber, ceramic fiber, glass fiber, and porous ceramic, and may include a mesh material.

The heater 52 may be an element for heating the first material 12 held in the wick 54. For example, the heater 52 may be a metal hot wire, a metal hot plate, a ceramic heater, and the like, and embodiments are not limited thereto. Also, the heater 52 may include an electrically conductive filament such as a nichrome wire and may include a structure wound around the wick 54 to surround the wick 54. When current is supplied to the heater 52, the heater 52 may generate heat, and the heater 52 may deliver heat to the first material 12 held in the wick 54 so that an aerosol may be generated.

The atomizer 50*a* may be empty inside. The inner space of the atomizer 50*a* may serve as an aerosol chamber in which air is supplied to the heater 52 and the wick 54, thereby creating an atmosphere for generating an aerosol.

The aerosol chamber inside the atomizer 50*a* may be connected to the delivery hole 11 through which the aerosol generated in the atomizer 50*a* is delivered to the outer surface of the first cartridge 10. Thus, the aerosol generated in the atomizer 50*a* may pass through the delivery hole 11 and then may be delivered to the second material 22 of the second cartridge 20 located outside the first cartridge 10.

The main body 70*a* may be detachably connected to the atomizer 50*a*. The controller 70 including a battery for supplying power to the atomizer 50*a* and a control chip or control circuit board for controlling the operation of the atomizer 50*a* may be installed in the main body 70*a*. The heater 52 of the atomizer 50*a* may be electrically connected to the electrical terminal 50*d* of the main body 70*a* by the wiring 51.

Figure 6:
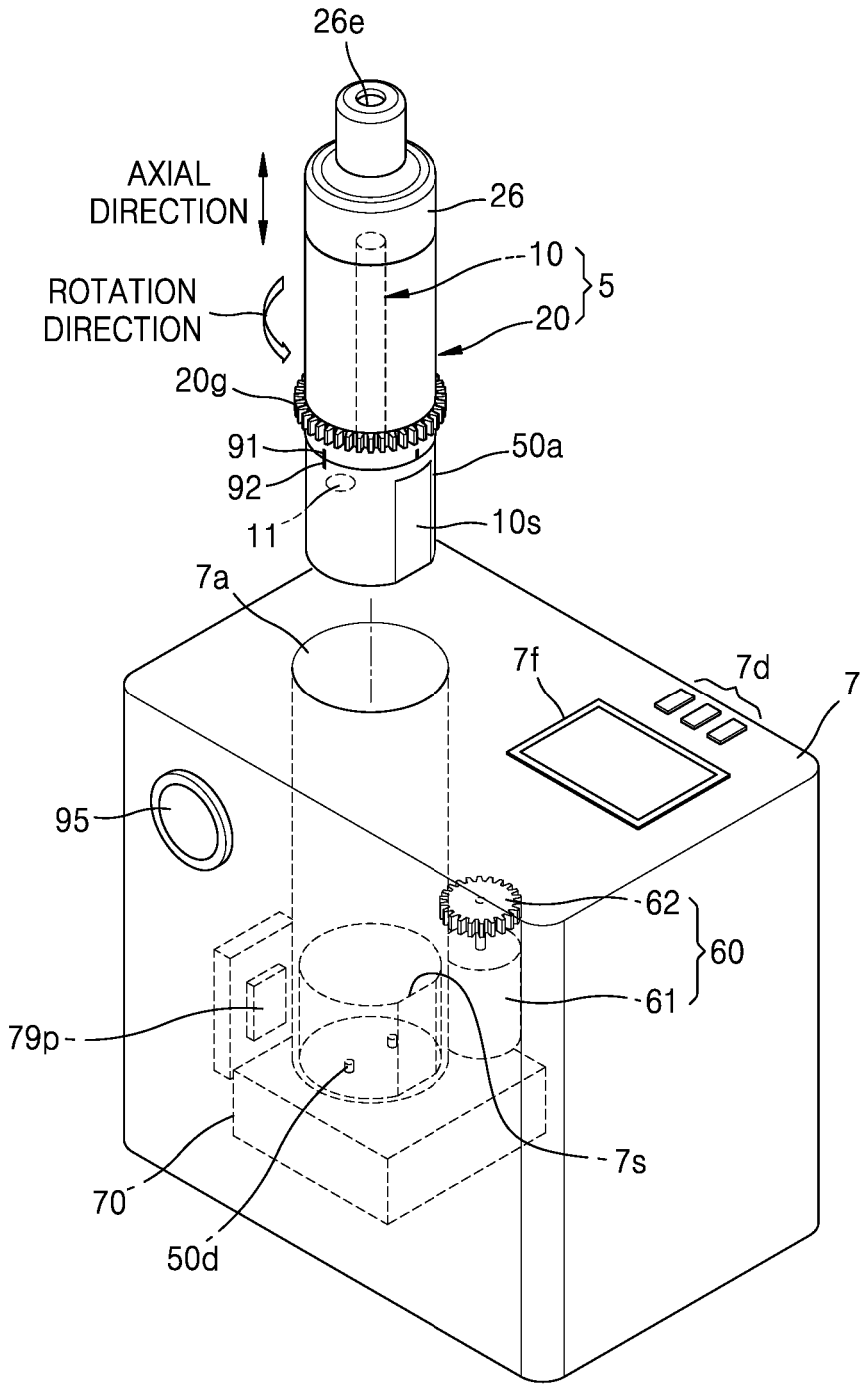
FIG. 6 is a perspective view of an aerosol generating device according to another embodiment.
Figure 7:
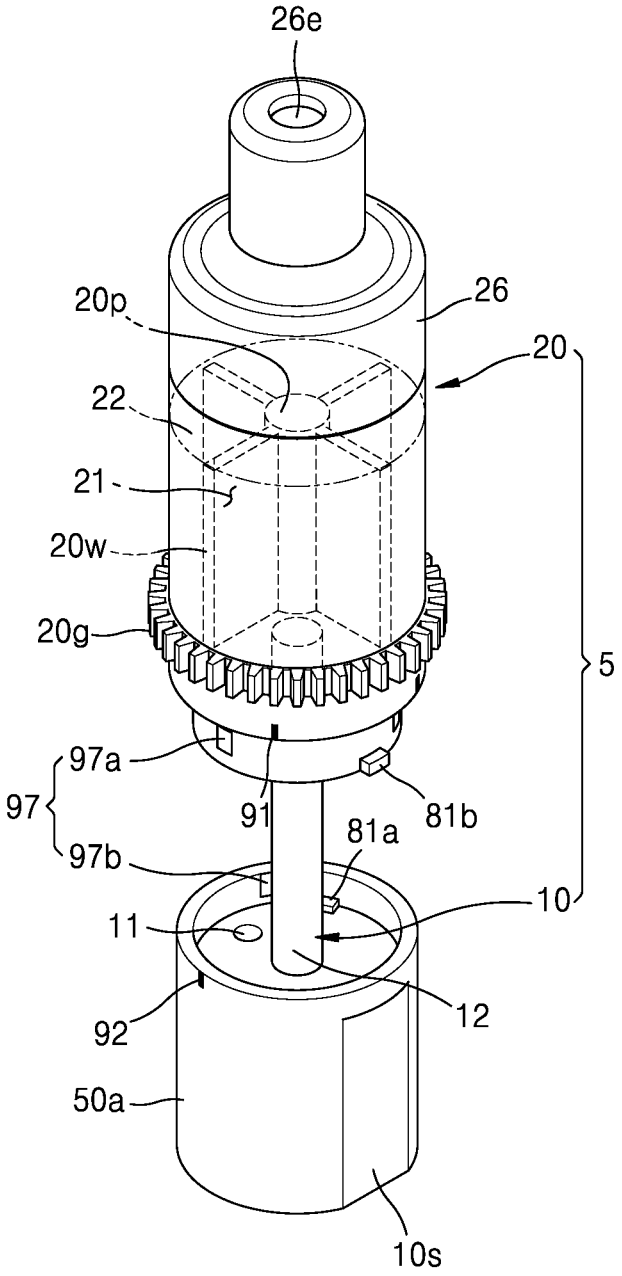
FIG. 7 is a perspective view illustrating some components of the aerosol delivering device according to the embodiment shown in FIG. 6.
Figure 8:
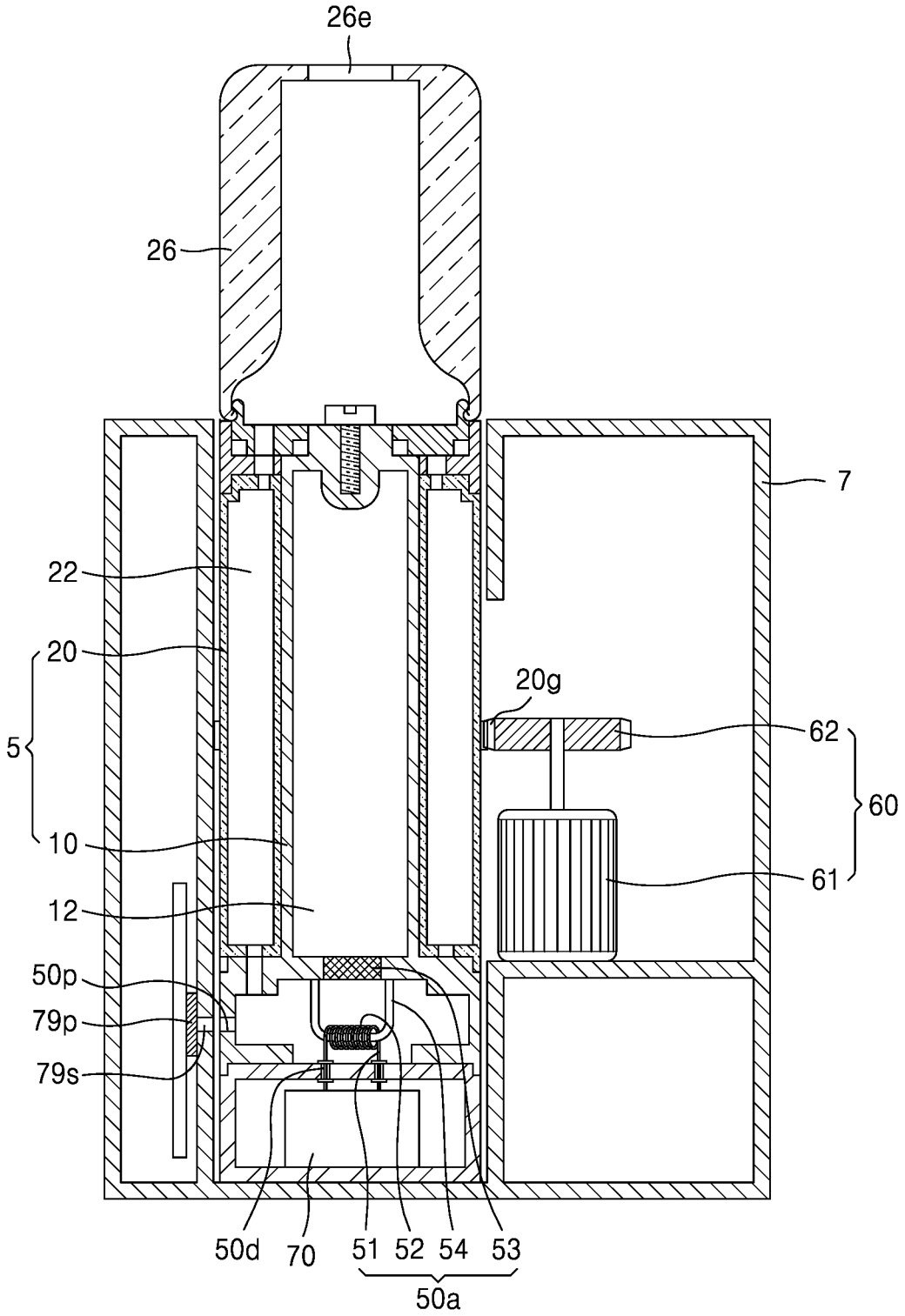
FIG. 8 is a longitudinal cross-sectional view of the aerosol generating device according to the embodiment shown in FIG. 6.

FIG. 6 is a perspective view of an aerosol generating device according to another embodiment, FIG. 7 is a perspective view illustrating some components of the aerosol delivering device according to the embodiment shown in FIG. 6, and FIG. 8 is a longitudinal cross-sectional view of the aerosol generating device according to the embodiment shown in FIG. 6.

The aerosol generating device according to the embodiment shown in FIGS. 6 through 8 may generate an aerosol and may heat an aerosol generating material by using a heater operated with electricity, an induction magnetic field, or ultrasonic waves so as to generate an aerosol.

Referring to FIG. 8, the aerosol generating device may include an aerosol delivering device 5 and an atomizer 50*a*.

The aerosol delivering device 5 may include a first cartridge 10 in which a first material 12 is accommodated and a second cartridge 20 in which a second material 22 is accommodated. The aerosol generated from the first material 12 may move along at least a portion of the outer surface of the first cartridge 10 such that the aerosol generated from the first material 12 may pass through the second material 22 before being discharged to the outside. The second cartridge 20 located outside the first cartridge 10 may be rotated with respect to the first cartridge 10.

The atomizer 50*a* is connected to the first cartridge 10, atomizes the first material 12 to generate an aerosol and delivers the aerosol toward the outer surface of the first cartridge 10.

The first cartridge 10 and the second cartridge 20 may be integrated with each other so as to be handled as one part and to form the aerosol delivering device 5.

Referring to FIG. 6, the aerosol generating device may include a case 7 including an accommodation passage 7*a* for accommodating the aerosol delivering device 5. The case 7 may include a display device 7*f* for providing information to a user and a display lamp 7*d* for providing a notification related to an operating state of the aerosol generating device to the user. The display device 7*f* and the display lamp 7*d* may be arranged on an outer surface of the case 7. The display device 7*f* and the display lamp 7*d* are examples of information generators for performing a function of notifying various types of notifications to the user, and an information generator may be in the form of, for example, a speaker or a vibration generator.

In addition, the case 7 may include an input device 95 that may be manipulated by the user and generates a user input signal by detecting the user's manipulation.

In the embodiment shown in FIGS. 6 through 8, the case 7 may approximately have a cuboid shape, and the aerosol delivering device 5 may have a cylindrical shape. However, embodiments are not limited to the shapes of the case 7 and the aerosol delivering device 5. For example, the case 7 may have other shapes such as a cylindrical shape that extends in the axial direction of the aerosol delivering device 5, a cylindrical shape having an elliptical cross-section, a flat cylindrical shape, a regular cube, and a rectangular parallelepiped. In addition, the aerosol delivering device 5 may have other shapes such as a cuboid, a regular cube, and the like.

The first cartridge 10 and the second cartridge 20 may be coupled to each other in such a way that relative positions of the first cartridge 10 and the second cartridge 20 may be changed. That is, the second cartridge 20 may be rotated relative to the first cartridge 10 so that the relative positions of the first cartridge 10 and the second cartridge 20 may be changed. The atomizer 50*a* connected to a lower end of the aerosol delivering device 5 may also have a cylindrical shape as a whole. The atomizer 50*a* may include a position fixing surface 10*s* that extends in a direction different from the extension direction of the cylindrical surface.

The accommodation passage 7*a* of the case 7 may be formed as a hollow cylindrical path that extends long to accommodate the aerosol delivering device 5. A position maintenance surface 7*s* may be formed on at least a portion of the accommodation passage 7*a*. The position maintenance surface 7*s* may extend in a direction different from the extension direction of the inner wall surface of the accommodation passage 7*a*, and may have a shape corresponding to the position fixing surface 10*s* of the first cartridge 10.

When the aerosol delivering device 5 is accommodated in the accommodation passage 7*a* of the case 7, the position maintenance surface 7*s* and the position fixing surface 10*s* are in contact with each other, and accordingly, the positions of the first cartridge 10 and the atomizer 50*a* with respect to the case 7 may be stably maintained. That is, when the second cartridge 20 is rotated with respect to the first cartridge 10, the position fixing surface 10*s* of the atomizer 50*a* connected to the first cartridge 10 is supported by the position maintenance surface 7*s* so that the first cartridge 10 and the atomizer 50*a* do not rotate but are fixed to the case 7.

In addition, when the aerosol delivering device 5 is inserted into the accommodation passage 7*a* of the case 7, the position maintenance surface 7*s* and the position fixing surface 10*s* may serve to align an axial center of the aerosol delivering device 5 with an axial center of the accommodation passage 7*a*. That is, the position fixing surface 10*s* of the aerosol delivering device 5 and the position maintenance surface 7*s* of the accommodation passage 7*a* need to correspond to each other so that the aerosol delivering device 5 may be inserted into the accommodation passage 7*a* of the case 7.

The case 7 may include an electrical terminal 50*d* that is installed at an end of the accommodation passage 7*a* and supplies electricity to the atomizer 50*a*. When the aerosol delivering device 5 is aligned with respect to the accommodation passage 7*a* so that the position fixing surface 10*s* of the aerosol delivering device 5 and the position maintenance surface 7*s* of the accommodation passage 7*a* correspond to each other, the electrical terminal 50*d* may be accurately connected to the atomizer 50*a*.

The first cartridge 10 may perform the function of delivering the first material 12 for generating an aerosol to the atomizer 50*a*. The first cartridge 10 may accommodate the first material 12 therein. The first material 12 may be, for example, a liquid or gel. The first material 12 may be in a liquid state and maintained in a porous material such as a sponge or cotton inside the first cartridge 10.

Referring to FIG. 8, the atomizer 50*a* may include an absorber 53, a wick 54, and a heater 52.

The absorber 53 may absorb the first material 12 from a lower portion of the first cartridge 10 and deliver the first material 12 to the wick 54.

The wick 54 may receive the first material 12 from the absorber 53 and holds the first material 12.

The heater 52 may be wound around the wick 54, or may be positioned adjacent to the wick 54. The heater may heat the first material 12 so as to generate an aerosol.

The atomizer 50*a* may generate an aerosol by converting a phase of the aerosol generating material into a gaseous phase. The aerosol may refer to a gas in which vaporized particles generated from the aerosol generating material are mixed with air.

The heater 52 may be an electric resistive heating element that is electrically connected to the electrical terminal 50*d* inside the case 7 by the wiring 51 and generates heat by electricity supplied from the controller 70. The atomizer 50*a* includes the electric resistive heating element. However, embodiments are not limited by the configuration of the atomizer 50*a*. For example, the atomizer 50*a* may generate an aerosol by an ultrasonic method, or by a heating method.

In addition, the atomizer 50*a* may perform the function of generating an aerosol from the first material 12 and then delivering the aerosol to the outer surface of the first cartridge 10. The atomizer 50*a* may include a delivery hole 11 connected to the first cartridge 10, and the atomizer 50*a* may discharge the aerosol through the delivery hole 11, so that the aerosol may be delivered to the second cartridge 20.

The second cartridge 20 may be located outside the first cartridge 10 and may be rotated with respect to the first cartridge 10. The second cartridge 20 may include a plurality of chambers 21 that are separated from each other by a barrier wall 20*w* and are sequentially positioned in the rotation direction of the second cartridge 20. Each chamber may include a second material 22 such that the aerosol passes through the second material 22. The second material 22 may be in a solid state and may be in the form of powder or granules (i.e., a collection of small-sized particles).

The number of chambers 21 in the second cartridge 20 may be variously modified. For example, only one chamber 21 may be installed in the second cartridge 20.

Referring to FIG. 7, the first cartridge 10 may protrude from the atomizer 50*a* and extend upward. When the second cartridge 20 is coupled to the first cartridge 10, the first cartridge 10 may be inserted into a cylindrical wall 20*p* of the second cartridge 20. When the first cartridge 10 is inserted into the cylindrical wall 20*p* of the second cartridge 20, the first cartridge 10 and the second cartridge 20 may be coupled to each other, and the second cartridge 20 may be rotated with respect to the first cartridge 10.

A mouthpiece 26 may include an outlet 26*e* for discharging the aerosol which has passed through at least one second material 22 of the chambers 21 to the outside. The mouthpiece 26 may be coupled to an upper portion of the second cartridge 20.

The relative positions of the first cartridge 10 and the second cartridge 20 may be changed in a state where the first cartridge 10 and the second cartridge 20 are coupled to each other. At least one of the plurality of chambers 21 of the second cartridge 20 may be connected to the delivery hole 11 of the atomizer 50*a*. Thus, the aerosol discharged from the delivery hole 11 of the atomizer 50*a* may pass through the second material 22 accommodated in the chamber which is positioned to correspond to the delivery hole 11 of the plurality of chambers 21 of the second cartridge 20. While the aerosol passes through the second material 22, the characteristics of the aerosol may be changed.

Referring to FIG. 8, a controller 70 including a battery for supplying power to the atomizer 50*a* and a control chip or control circuit board for controlling the operation of the atomizer 50*a* may be installed at a lower side of the accommodation passage 7*a* inside the case 7.

The aerosol generating device may include a driving device 60 that generates a driving force to rotate the second cartridge 20. Referring to FIGS. 6 and 8, the driving device 60 may include a motor 61 that is located inside the case 7 and operated by an electrical signal, and a gear 62 that transmits a driving force of the motor 61 to the second cartridge 20. A gear surface 20*g* may be arranged outside the second cartridge 20 along the rotation direction of the second cartridge 20.

When the aerosol delivering device 5 is mounted on the case 7, the gear surface 20*g* of the second cartridge 20 and the gear 62 may engage with each other. When the electrical signal of the controller 70 is applied to the motor 61 of the driving device 60, a shaft of the motor 61 may make a rotational motion, and the driving force of the motor 61 may be transmitted to the gear surface 20*g* of the second cartridge 20 via the gear 62. Thus, the driving device 60 may perform the function of rotating the second cartridge 20 with respect to the first cartridge 10.

Embodiments are not limited by the configuration of the driving device 60 shown in FIGS. 6 and 8. For example, the gear 62 of the driving device 60 may be replaced with various power transmission elements such as a belt, a sprocket, and the like.

As aforementioned, at least one of the plurality of chambers 21 of the second cartridge 20 may be connected to the delivery hole 11 of the atomizer 50*a*. That is, the aerosol discharged from the delivery hole 11 of the atomizer 50*a* may pass through one or more chambers (e.g., two or more adjacent chambers) from among the plurality of chambers 21.

Referring to FIGS. 6 and 7, the second cartridge 20 may include a mark 91 located on an outer surface of the second cartridge 20. The mark 91 of the second cartridge 20 may be formed at a position corresponding to each of the plurality of chambers 21 inside the second cartridge 20.

The atomizer 50*a* may include a mark 92 that may be used as a reference position with respect to the mark 91 of the second cartridge 20 on an outer surface of the atomizer 50. Thus, when the mark 91 of the second cartridge 20 is aligned with the mark 92 of the first cartridge 10, the position of at least one of the chambers may be aligned with the position of the delivery hole 11 of the atomizer 50*a* through which the aerosol is discharged.

In addition, the user may check the positions of the mark 91 of the second cartridge 20 and the mark 92 of the atomizer 50*a* to identify a chamber through which the aerosol currently passes, among the chambers 21 of the second cartridge 20.

Referring to FIG. 7, a position sensor 97 for identifying the type of the second material 22 included in the chamber through which the aerosol currently passes among the chambers 21 according to the relative positions of the first cartridge 10 and the second cartridge 20 may be installed in the second cartridge 20 and/or the atomizer 50*a*. The position sensor 97 may perform the function of detecting the position of at least one of the chambers 21 with respect to the delivery hole 11 to generate a signal.

The position sensor 97 may include senders 97*a* arranged in the second cartridge 20 and a receiver 97*b* that is disposed in the atomizer 50*a* and detects the senders 97*a*. Embodiments are not limited by the arrangement positions or the number of the senders 97*a* and the receiver 97*b*. For example, the senders 97*a* may be arranged in the atomizer 50*a*, and the receiver 97*b* may be arranged in the second cartridge 20. A plurality of senders 97*a* may be arranged to correspond to each of the chambers 21.

When the rotation position of the second cartridge 20 with respect to the first cartridge 10 is aligned so that at least one of the chambers 21 corresponds to the delivery hole 11, the position sensor 97 may generate an identification signal indicating the aligned chamber(s).

The senders 97*a* and the receiver 97*b* of the position sensor 97 may be implemented by at least one of an optical sensor (e.g., a photocoupler), a magnetic sensor that detects magnetism by using the hall effect, an electric resistance sensor that detects changes in electric resistance, and a switch that generates a signal according to a physical contact.

Referring to FIGS. 6 and 8, the puff sensor 79*p* may be arranged on a flow path of the aerosol, inside the case 7. The puff sensor 79*p* may detect the user's aerosol inhalation based on the flow of the aerosol. For example, the puff sensor 79*p* may be connected to the inner space of the atomizer 50*a*, detect the change in pressure or flow rate of air (i.e., mainstream including an aerosol) flowing through the inside of the atomizer 50*a*, and generate a signal based on the detected change. The puff sensor 79*p* may be arranged in a pressure detection hole 79*s* connected to the delivery passage 50*p* of the atomizer 50*a*.

In the aerosol generating device described above, the aerosol discharged from the atomizer 50*a* may enter the chambers 21 of the second cartridge 20 and pass through the second material 22 accommodated in the chambers 21. The second material 22 may provide flavors to the aerosol. As a result, the aerosol that has passed through the second material 22 may have sufficient flavors and may be discharged to the outside of the aerosol generating device through the mouthpiece 26.

When pre-set conditions are achieved, the controller 70 may operate the driving device 60 to perform the function of changing the relative positions of the first cartridge 10 and the second cartridge 20 so that the aerosol delivered from the first cartridge 10 may pass through at least one of the chambers 21. For example, the second material 22 contained in the chambers 21 of the second cartridge 20 may have a pre-set usage time in relation to an operation of passing the aerosol, and the preset usage time of the second material 22 may be a pre-set condition. When an actual usage time used to perform the operation of passing the aerosol through the second material 22 reaches the pre-set usage time, the positions of the chambers need to be changed such that the aerosol may pass through a new second material.

The controller 70 may change the relative position of the second cartridge 20 with respect to the first cartridge 10 to perform a function of selecting another one or two adjacent chambers of the second cartridge 20 to pass the aerosol.

Also, the controller 70 may perform the function of identifying a chamber that is currently aligned to correspond to the position of the delivery hole 11 among the chambers 21 and is in use to pass the aerosol, based on the signal of the position sensor 97. Hereinafter, the term "usage chamber" may refer to one or more chambers from among the chambers 21, which are aligned to correspond to the position of the delivery hole 11 and in use to perform a function of passing the aerosol.

Referring to FIG. 7, stoppers 81*a* and 81*b* may be installed in the atomizer 50*a* and the second cartridge 20 so as to limit changes in the relative positions of the first cartridge 10 and the second cartridge 20. The stoppers 81*a* and 81*b* may perform the function of limiting a rotational motion of the second cartridge 20 when the chambers 21 of the second cartridge 20 make a relative rotational motion with respect to the first cartridge 10.

When the second cartridge 20 makes a rotational motion in one direction with respect to the first cartridge 10 and the stoppers 81*a* and 81*b* are in contact with each other, the second cartridge 20 may no longer make a rotational motion in the same direction, and the driving device 60 may change the direction of the rotational motion of the second cartridge.

Figure 9:
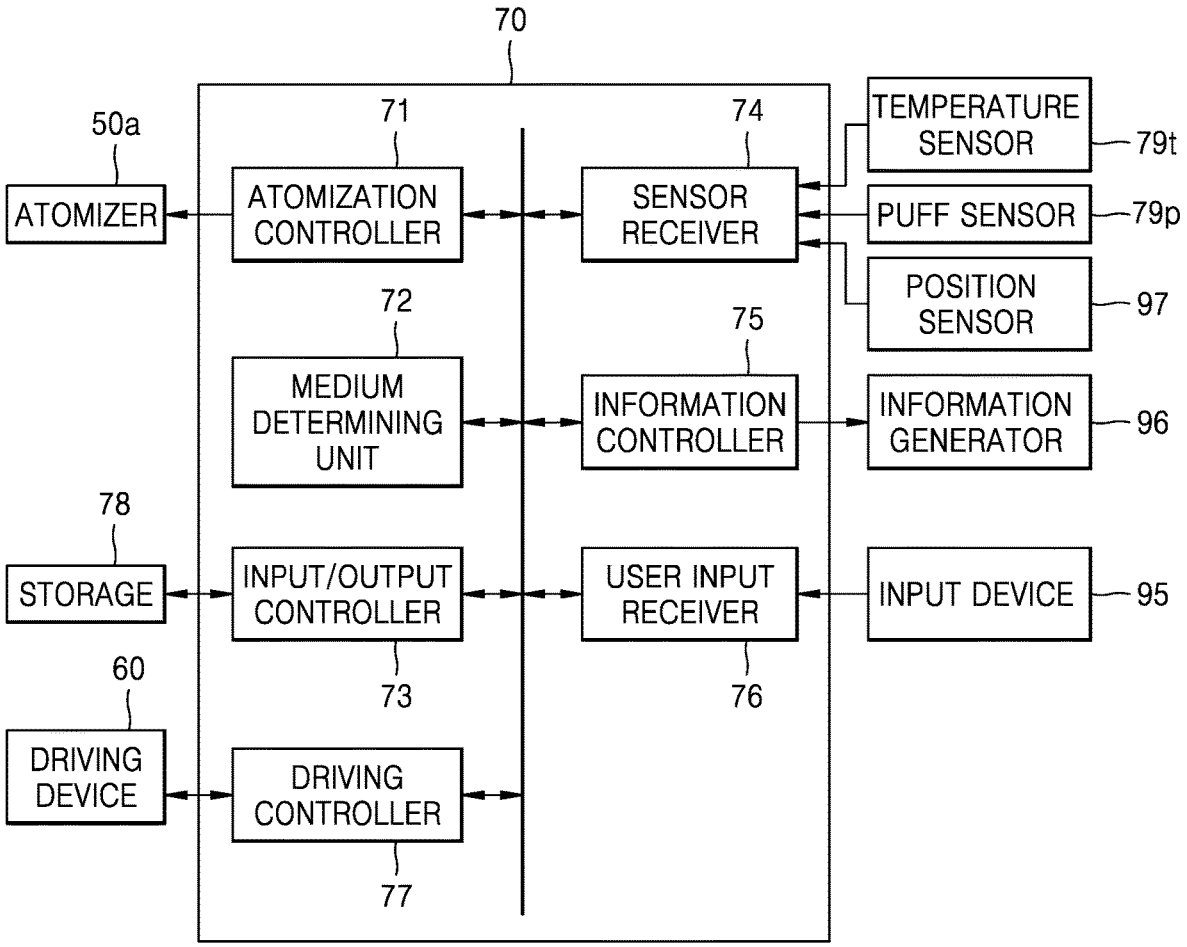
FIG. 9 is a block diagram schematically illustrating some components of the aerosol generating device according to the embodiment shown in FIG. 6.

FIG. 9 is a block diagram schematically illustrating some components of the aerosol generating device according to the embodiment shown in FIG. 6.

The controller 70 shown in FIG. 9 may be implemented by any one of a circuit hoard arranged inside the case 7 shown in FIGS. 6 and 8, a semiconductor chip attached to the circuit board, and software installed on the semiconductor chip or circuit board, or a combination thereof.

The controller 70 may include an atomization controller 71, a sensor controller 74, an information controller 75, a user input receiver 76, an input/output controller 73, a medium determining unit 72, and a driving controller 77.

The atomization controller 71 controls the atomizer 50*a* to control the generation amount or the temperature of the aerosol.

The sensor controller 74 receives signals generated by a temperature sensor 79*t* for detecting the temperature related to the atomizer 50*a*, a puff sensor 79*p* for detecting changes in pressure or speed of air generated when the user inhales the aerosol, and the position sensor 97 for detecting the rotation position of the second cartridge 20 with respect to the first cartridge 10.

The information controller 75 controls an information generator 96 for providing information to the user or providing a notification.

The user input receiver 76 receives a user input signal from an input device 95 such as a button, a touch screen or an input button for detecting the users input.

The input/output controller 73 exchanges data with a storage 78, such as information about the type of the first material of the first cartridge 10 or the second material of the second cartridge 20, a temperature profile for controlling the operating temperature of the atomizer 50*a*, information about the user, and information about the positions of the chambers 21 with respect to the delivery hole 11 according to changes in the relative positions of the first cartridge 10 and the second cartridge 20.

The medium determining unit 72 determines a usage chamber and the type of a medium (i.e., second material) contained in the usage chamber based on the signal received from the position sensor 97.

The driving controller 77 controls the operation of the driving device 60.

The controller 70 described above may detect the user's inhalation, thereby initiating or stopping the operation of the atomizer 50*a*. Also, the controller 70 may determine the usage chamber and the type of the medium (i.e., second material) contained in the usage chamber based on the signal applied from the position sensor 97, and may control the operating temperature or operating time of the atomizer 50*a* to be suitable for the type of medium.

The controller 70 may determine the usage chamber and the type of the medium contained in the usage chamber based on the signal from the position sensor 97, and then may output information about the type of the usage chamber (i.e., a pre-set identifier of the usage chamber) to the information generator 96. The pre-set identifier of the usage chamber may include, for example, numbers, characters, or symbols. Also, the controller 70 may output information about the type of the medium contained in the usage chamber, for example, the name of the medium or the characteristics of the medium (e.g., flavors or useful life) to the information generator 96.

The controller 70 may operate the driving device 60 when the pre-set conditions are met. The pre-set conditions for changing the relative positions of the first cartridge 10 and the second cartridge 20 may include a cumulative time of heating operations of the heater and/or the heating temperature of the heater.

When the pre-set conditions are met, the controller 70 may generate a notification indicating that the relative positions of the first cartridge 10 and the second cartridge 20 need to be changed, through the information generator 96. If the user checks the notification and manipulates the input device 95, the controller 70 may operate the driving device 60 to change the relative positions of the first cartridge 10 and the second cartridge 20 based on the input signal from the input device 95.

If the pre-set conditions include the cumulative time of heating operations of the heater, the controller 70 may calculate the cumulative time of heating operations of the heater by summing up time when the current is supplied to the heater or by calculating the amount of current or the amount of power supplied to the heater by the atomization controller 71. For example, when the aerosol passes through the second material 22 included in one of the chambers 21 of the second cartridge 20 and the service life of the second material for providing flavors to the aerosol is n minutes, the controller 70 may determine, when the cumulative time of heating operations of the heater reaches n minutes, that the use of a chamber through which the aerosol is currently passing needs to be ended. Also, the controller 70 may select another chamber from among the chambers 21 as a new usage chamber by changing the relative position of the second cartridge 20 to the first cartridge 10.

The heating operation of the heater may include a main heating operation of generating heat at a sufficient temperature to vaporize the first material of the first cartridge 10 and a pre-heating operation of generating heat in a certain temperature range that is lower than the temperature corresponding to the main heating operation. The heating operation of the heater included in the pre-set conditions for operating the driving device 60 by using the controller 70 may be a main heating operation.

The case where the pre-set conditions include the combination of the cumulative time of heating operations of the heater and the heating temperature of the heater may be more useful when the heating operation of the heater includes the main heating operation and the pre-heating operation. For example, when the service life of the second material 22 for providing flavors to the aerosol is pre-set to n minutes, the controller 70 may count the cumulative time of heating operations of the heater only when the heating temperature of the heater reaches the temperature corresponding to the main heating operation.

The pre-set conditions for changing the relative positions of the first cartridge 10 and the second cartridge 20 may include the number of puffs determined based on the detection signal from the puff sensor 79*p* and/or the cumulative time of puffs. When the intensity of the detection signal from the puff sensor 79*p* exceeds a preset threshold value, the controller 70 may determine that a valid inhalation has been performed by the user and may count the number of puffs.

When the pre-set conditions include the number of puffs, the controller 70 may count the number of puffs performed on the usage chamber based on the signal generated by the puff sensor 79*p*. In this case, the controller 70 may simply count only the number of puffs that have occurred based on the signal of the puff sensor 79*p*, ignoring the cumulative time of puffs.

For example, if the service life of the second material 22 for providing flavors to the aerosol is pre-set to m puffs, the controller 70 may determine, when the number of puffs reaches m times, that the use of the chamber through which the aerosol currently passes needs to be ended. Also, the controller 70 may select another chamber from among the chambers 21 as a new usage chamber by changing the relative positions of the second cartridge 20 with respect to the first cartridge 10.

The controller 70 may determine a position changing time of the second cartridge 20 for selecting a new chamber based on the use environment of the aerosol generating device or the user's inhalation habit. To this end, the pre-set conditions may include the cumulative time of puffs and/or the number of puffs.

The operation of the aerosol generating device in a case where the pre-set conditions include the combination of the number of puffs and the cumulative time of puffs will be described in detail. For example, if the service life of the second material 22 is p minutes in terms of the cumulative time of puffs and m puffs in terms of the number of puffs, the controller 70 may determine that the use of the chamber through which the aerosol currently passes needs to be ended if both conditions are satisfied. Thus, even if the number of puffs reaches m times based on the signal of the puff sensor 79*p*, if the cumulative time of puff operations has not reached p minutes, the controller 70 may maintain the position of the chamber through which the aerosol currently passes until the cumulative time of puffs reaches p minutes. In this case, the number of puffs may exceed m times before the usage chamber is changed.

Alternatively, the controller 70 may determine that the use of the chamber through which the aerosol currently passes needs to be ended when either condition (i.e., m puffs or p minutes) is satisfied.

According to an embodiment, the pre-set condition for changing the relative positions of the first cartridge 10 and the second cartridge 20 may include a usage time determined based on an input signal generated when the input device 95 receives the user's input. Using the usage time as the pre-set condition may be useful in a case where the user manually initiates the operation of the heater. For example, for the purpose of satisfying the user's tastes or improving the user's convenience, the aerosol generating device may provide a function in which the heater of the atomizer starts a main heating operation immediately without a separate pre-heating operation, in response to the user input on the input device 95. In this case, the usage time of the atomizer may be determined based on the input signal of the input device 95. Therefore, when the usage time (i.e., operating time) of the atomizer reaches a pre-set reference usage time, the controller 70 may determine to end the use of the usage chamber and may change the relative positions of the second cartridge 20 with respect to the first cartridge 10 to select another chamber from among the chambers 21 as a new usage chamber.

In the above description, characters such as m, n, and p may denote integers or real numbers.

The pre-set condition for changing the relative positions of the first cartridge 10 and the second cartridge 20 may include a selection condition indicating that a user input for selecting at least one of the chambers 21 as a usage chamber is received through the input device 95.

The chambers 21 of the second cartridge 20 may include the second material 22 having different types of mediums or different particle sizes, and the controller 70 may control the display lamp 7*d* to emit light or change an emission color, or control the display device 7*f* to display information, thereby providing information about the second material 22 included in the usage chamber (i.e., a chamber aligned with the position of the delivery hole 11 of the atomizer 50*a* and used to pass the aerosol) among the chambers 21 of the second cartridge 20 to the user.

When the user manipulates the input device 95 to select a desired chamber from among the chambers 21, the controller 70 may determine that the selection condition is met, and may change the relative positions of the first cartridge 10 and the second cartridge 20.

Before mounting the aerosol delivering device 5 on the case 7, a user may adjust the rotation position of the second cartridge 20 so that the position of at least one of the chambers 21 of the second cartridge 20 coincides with a position corresponding to the delivery hole 11 of the atomizer 50*a*. After adjusting the relative positions of the first cartridge 10 and the second cartridge 20, the user may mount the aerosol delivering device 5 on the case 7.

Alternatively, when the user mounts the aerosol delivering device 5 on the case 7, the driving device 60 embedded in the case 7 may automatically rotate the second cartridge 20 to an initial position for generating an aerosol. When the second cartridge 20 is at the "initial position," a predetermined chamber among the chambers 21 may be aligned with the delivery hole 11.

In a state in which the position of at least one of the chambers 21 of the second cartridge 20 corresponds to the position of the delivery hole 11 of the first cartridge 10, the user may inhale the aerosol through the mouthpiece 26.

The aerosol delivering device 5 of the aerosol generating device may be handled as one device in which the first cartridge 10 for accommodating the first material 12 and the second cartridge 20 for accommodating the second material 22 are integrated with each other, and thus is convenient to carry and use.

In addition, even when the first cartridge 10 of the aerosol generating device is designed to accommodate a large amount of the first material 12 compared to the second material 22, the second cartridge 20 may be automatically rotated by the driving device 60 to change the usage chamber, so that the second material 22 may be replaced without replacing the second cartridge.

In addition, the chambers 21 of the second cartridge 20 may include different types of second materials 22. For example, the chambers 21 may include the second material 22 having different particle sizes or different flavors. In this case, the controller 70 may identify the 'usage chamber' which is a chamber currently passing the aerosol (i.e., a chamber aligned with the delivery hole 11), among the chambers 21. Because the usage chamber identified by the controller 70 and information about the second material 22 included in the usage chamber may be provided to the user, the user may select one of the chambers 21 to select a desired second material 22, thereby freely enjoying the aerosol having various flavors according to the user's preference.

Figure 10:
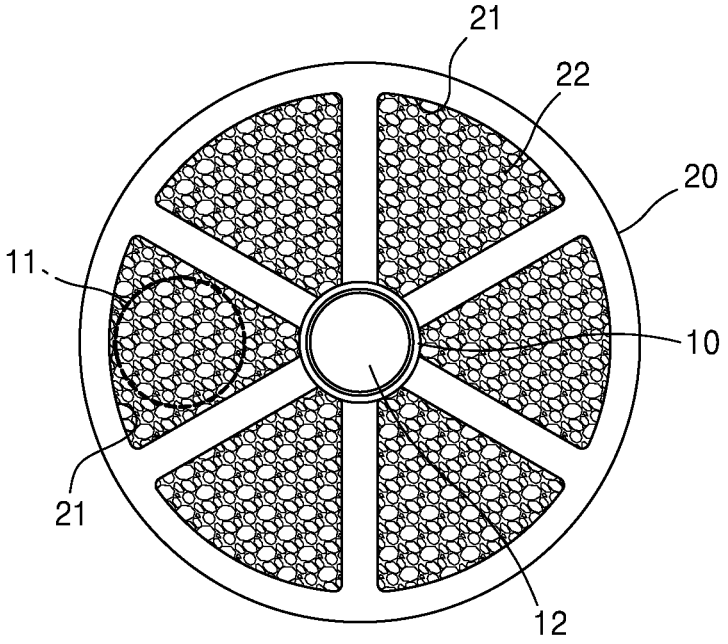
FIG. 10 is a latitudinal cross-sectional view illustrating an operating state of an aerosol delivering device according to another embodiment.

FIG. 10 is a latitudinal cross-sectional view illustrating an operating state of an aerosol delivering device according to another embodiment.

In the aerosol delivering device according to the embodiment shown in FIG. 10, a first cartridge 10 may accommodate a first material 12, and a second cartridge 20 may be located outside the first cartridge 10 and may be rotatably coupled to the first cartridge 10. The second cartridge 20 may include a plurality of chambers 21 sequentially arranged in a rotation direction, and a second material 22 may be accommodated in each of the plurality of chambers 21.

The second cartridge 20 may be rotated with respect to the first cartridge 10 by a driving device or user's manipulation action so that the relative rotation position of the second cartridge 20 with respect to the first cartridge 10 may be changed.

As shown in FIG. 10, the rotation position of the second cartridge 20 with respect to the first cartridge 10 may be aligned so that the position of one chamber from among the chambers 21 of the second cartridge 20 may correspond to the position of the delivery hole 11 (i.e., a single hole). In the aligned state shown in FIG. 10, the aerosol delivered from the delivery hole 11 passes through one of the chambers 21 of the second cartridge 20, so that the function of changing the characteristics of the aerosol may be performed.

Figure 11:
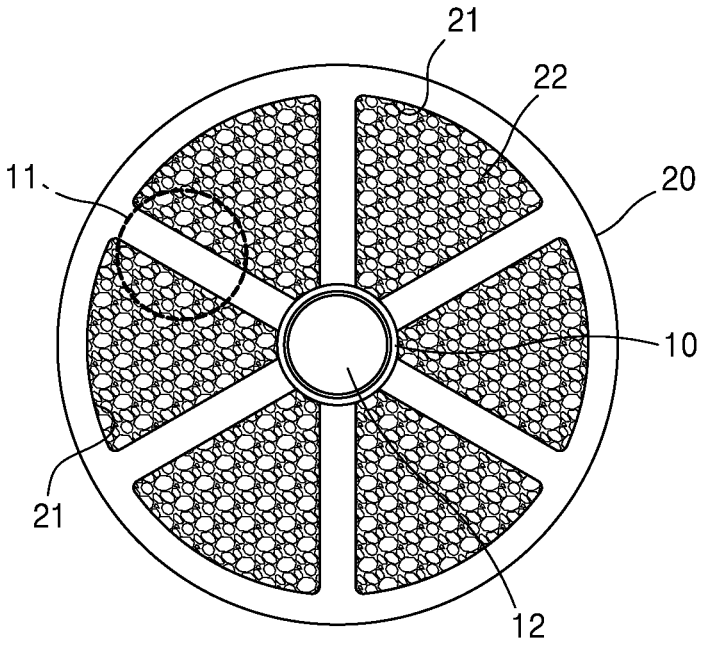
FIG. 11 is a latitudinal cross-sectional view illustrating another operating state of the aerosol delivering device according to the embodiment shown in FIG. 10.

FIG. 11 is a latitudinal cross-sectional view illustrating another operating state of the aerosol delivering device according to the embodiment shown in FIG. 10.

The second cartridge 20 may rotate by the driving device so that the relative positions of the second cartridge 20 with respect to the first cartridge 10 is changed, as shown in FIG. 11. As a result, the rotation position of the second cartridge 20 with respect to the first cartridge 10 may be aligned so that the position of two adjacent chambers 21 may correspond to the position of one delivery hole 11.

In FIG. 11, each of two adjacent chambers among the chambers 21 of the second cartridge 20 may be positioned to overlap a region corresponding to the half of one delivery hole 11. However, embodiments are not limited by the alignment position of the second cartridge 20 shown in FIG.

11. That is, the rotation position of the second cartridge 20 with respect to the first cartridge 10 may be aligned so that the areas in which two adjacent chambers of the chambers 21 overlap the delivery hole 11 are different from each other.

For example, when the remaining service life of the second material 22 contained in one of the two adjacent chambers 21 reaches 20%, the second cartridge 20 may be positioned such that the chamber overlaps an area corresponding to about 80% of the delivery hole 11, and the other chamber overlaps an area corresponding to about 20% of the delivery hole 11.

As another example, when the remaining service life of the second material 22 contained in one of the two adjacent chambers 21 reaches 60%, the second cartridge 20 may be positioned such that the chamber overlaps an area corresponding to about 40% of the delivery hole 11, and the other chamber overlaps an area corresponding to about 60% of the delivery hole 11.

As another example, when the service life of the second material 22 contained in one of the two adjacent chambers 21 reaches 80%, the second cartridge 20 may be positioned such that the chamber overlaps an area corresponding to about 20% of the delivery hole 11, and the other chamber overlaps an area corresponding to about 80% of the delivery hole 11.

A pre-set condition used to change the relative positions of the first cartridge 10 and the second cartridge 20 by using the controller may include the service life of the second material 22, which is associated with the function of passing the aerosol through the second material 22, as described above.

Also, in order to change the overlapping areas between the adjacent chambers 21 and the delivery hole 11 based on the service life of the second material 22 of the chambers 21, the second cartridge 20 may rotate intermittently or continuously.

In the embodiment illustrated in FIG. 11 where two adjacent chambers overlap the delivery hole 11, the operation of generating an aerosol in the first cartridge and delivering the generated aerosol to the second cartridge 20 may be continuously maintained while the second cartridge 20 rotates with respect to the first cartridge 10.

Also, the relative positions of the first cartridge 10 and the second cartridge 20 may be changed so that the usage chamber may be sequentially selected from among the plurality of chambers 21. When the second cartridge 20 rotates to change the usage chamber, the position of the previous usage chamber may not be immediately separated from the delivery hole 11. Instead, during the rotation of the second cartridge 20, the previous usage chamber and the new usage chamber may perform an operation of passing the aerosol at the same time.

According to this operating method, while the relative positions of the first cartridge 10 and the second cartridge 20 are being changed, characteristics such as temperature, humidity and flavor of the aerosol delivered to the user do not change abruptly, thereby securing a steady and stable supply of an aerosol.

Also, when each of the plurality of chambers 21 of the second cartridge 20 includes the second material 22 having different characteristics, the characteristics of the aerosol such as ingredients and flavors may be changed as the aerosol may pass through the adjacent chambers. Accordingly, various types of aerosols may be provided to the user.

Figure 12:
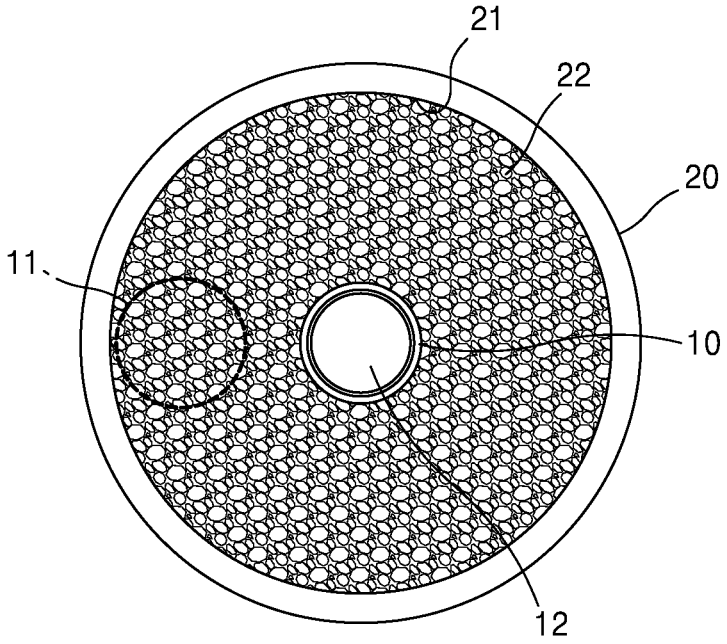
FIG. 12 is a latitudinal cross-sectional view of an aerosol delivering device according to another embodiment.

FIG. 12 is a latitudinal cross-sectional view of an aerosol delivering device according to another embodiment.

In the aerosol delivering device according to the embodiment shown in FIG. 12, a first cartridge 10 may accommodate a first material 12, and a second cartridge 20 may be located outside the first cartridge 10 and may be rotatably coupled to the first cartridge 10.

The second cartridge 20 may include a single chamber 21 that extends in the rotation direction of the second cartridge 20 to surround at least a portion of the first cartridge 10. A second material 22 may be accommodated in a single chamber 21. In FIG. 12, a single chamber 21 surrounds the entire region in a circumferential region of the first cartridge 10, but embodiments are not limited by the structure of the chamber 21. For example, the chamber 21 may be arranged to surround only a partial region in the circumferential direction of the first cartridge 10.

The second cartridge 20 may be rotated with respect to the first cartridge 10 by using a driving device or user's manipulation action, so that the relative rotation position of the second cartridge 20 with respect to the first cartridge 10 may be changed.

When the second cartridge 20 is driven by the driving device, the second cartridge 20 may be continuously rotated over time. In order for the second cartridge 20 to be continuously rotated over time, the rotation speed of the second cartridge 20 may be determined based on the service life of the second material 22, which is associated with a function of passing the aerosol through the second material 22.

Embodiments are not limited by the rotation speed or rotation method of the second cartridge 20, and the second cartridge 20 may be rotated intermittently in consideration of the length of the arc of the second cartridge 20 that allows the aerosol to pass through delivery hole 11 and the area of the second material 22 corresponding to the size of the delivery hole 11. The expression "rotated intermittently" means that a certain period (i.e., time interval) is pre-set and the second cartridge 20 is rotated whenever the certain period elapses.

Although the chamber 21 is not visually partitioned for intermittent rotational motion of the second cartridge 20, the controller may divide the chamber 21 into a plurality of regions in advance along the circumferential direction of the second cartridge 20 in consideration of the area of the second material 22 corresponding to the size of the delivery hole 11. In addition, when the service life of the second material 22 in the current region that passes the aerosol from among the plurality of regions of the chamber 21 expires, the controller may rotate the second cartridge 20 so that the next region among a plurality of regions of the chamber 21 may be aligned with the delivery hole 11.

Figure 13:
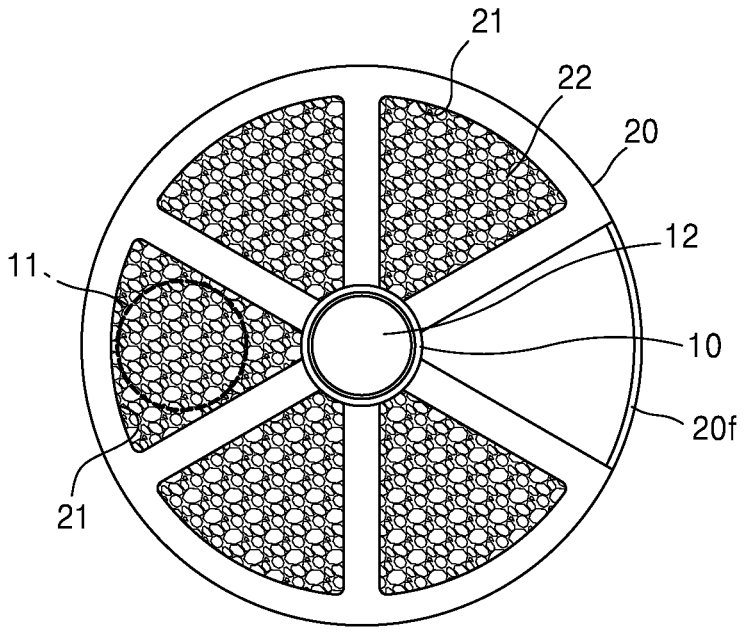
FIG. 13 is a latitudinal cross-sectional view of an aerosol delivering device according to another embodiment.

FIG. 13 is a latitudinal cross-sectional view of an aerosol delivering device according to another embodiment.

In the aerosol delivering device according to the embodiment shown in FIG. 13, a first cartridge 10 may accommodate a first material 12, and a second cartridge 20 may be located outside the first cartridge 10 and may be rotatably coupled to the first cartridge 10.

The second cartridge 20 may be rotated with respect to the first cartridge 10 by using a driving device or user's manipulation action, so that the relative rotation position of the second cartridge 20 with respect to the first cartridge 10 may be changed.

At least a portion of the first cartridge 10 may include a transparent material so that the remaining amount of the first material 12 may be visually checked from the outside. The entire region or a partial region of the first cartridge 10 accommodating the first material 12 may include a transparent material such as glass or plastic.

The second cartridge 20 may include a plurality of chambers 21 which are sequentially arranged in the rotation direction of the second cartridge 20 to surround at least a portion of the first cartridge 10 and accommodate the second material 22. Also, a transparent window 20*f* may be arranged between the plurality of chambers 21 such that a transparent material of the first cartridge 10 is exposed to the outside through the transparent window 20*f*.

According to the aerosol delivering device described above, the remaining amount of the first material 12 accommodated in the first cartridge 10 may be checked from the outside of the aerosol delivering device through the transparent window 20*f* of the aerosol delivering device. Thus, the user may check the remaining amount of the first material 12 accommodated in the first cartridge 10, and may rotate the second cartridge 20 in consideration of the remaining amount of the first material 12. Also, the user may replace the aerosol delivering device if necessary.

Embodiments are not limited by a structure in which the transparent window 20*f* is installed in the second cartridge 20 having the plurality of chambers 21, as shown in FIG. 13. For example, a transparent window may also be installed in the second cartridge 20 having a single chamber 21 shown in FIG. 12.

Figure 14:
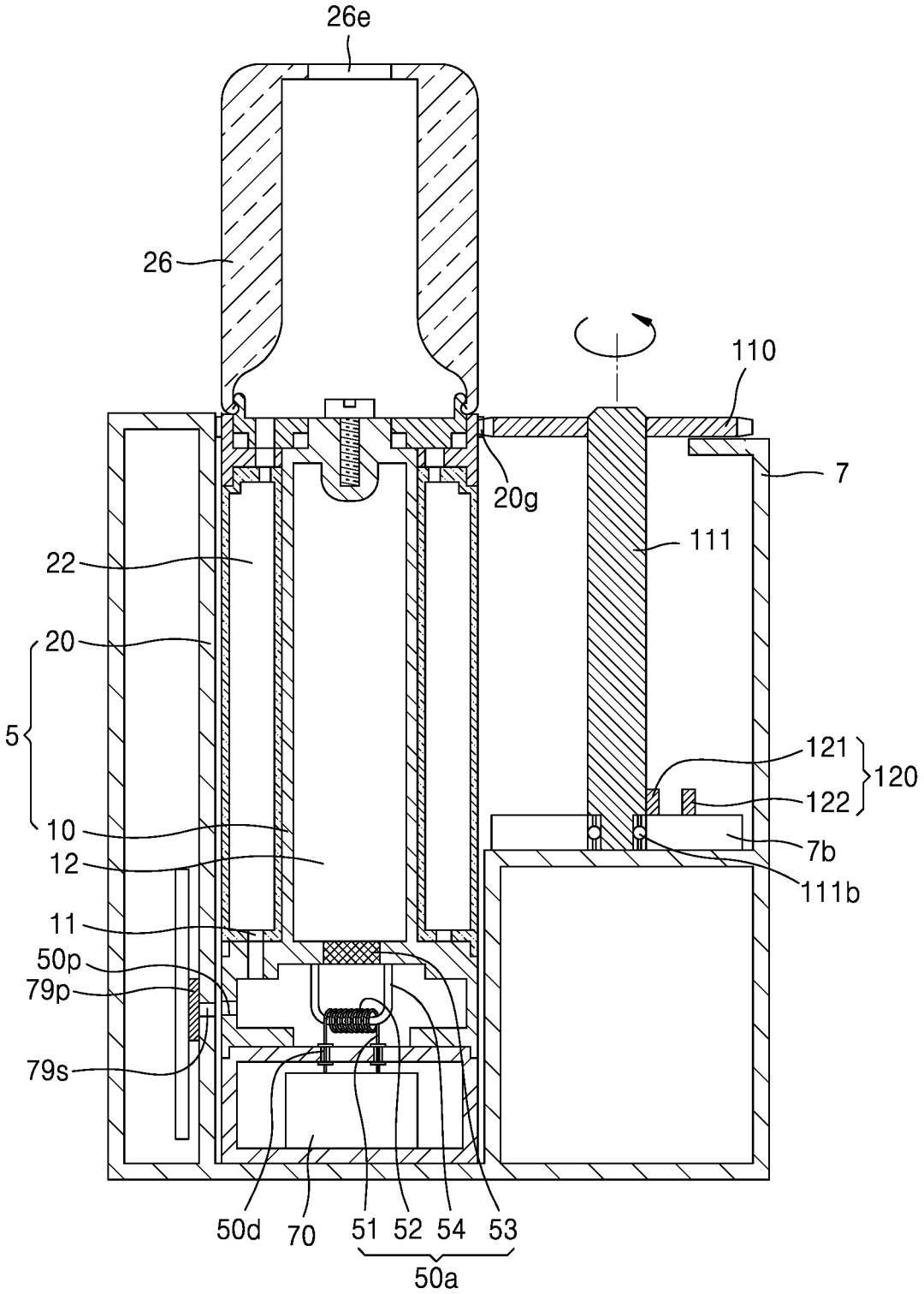
FIG. 14 is a longitudinal cross-sectional view of an aerosol generating device according to another embodiment.

FIG. 14 is a longitudinal cross-sectional view of an aerosol generating device according to another embodiment. The aerosol generating device according to the embodiment shown in FIG. 14 is generally similar to the aerosol generating device according to the embodiment shown in FIGS. 6 through 8.

The aerosol generating device according to the embodiment shown in FIG. 14 may include a handle 110 that may be manually operated by the user. The handle 110 may be used instead of a driving device such as a motor so as to change the relative positions of the first cartridge 10 and the second cartridge 20.

The handle 110 may be connected to a handle shaft 111 rotatably arranged in the case 7, and a bottom end of the handle shaft 111 may be rotatably coupled to a base 7*b* of the case 7 by a bearing 111*b*.

A gear may be installed at an outer edge along a circumferential direction of the handle 110, and the gear of the handle 110 may be engaged with a gear surface 20*g* that extends in the rotation direction of the second cartridge 20.

A switch 120 that generates a position signal indicating the position of the chambers 21 according to changes in the relative positions of the second cartridge 20 with respect to the first cartridge 10 may be installed at a lower end of the handle shaft 111. The switch 120 may be an example of the position sensor.

The switch 120 may include a sender 121 installed at a lower end of the handle shaft 111, and a receiver 122 that is arranged inside the case 7 and detects a signal transmitted from the sender 121. The installation position of the sender 121 may be variously changed, and the sender 121 may be arranged on an outsider surface of the second cartridge 20, for example.

The switch 120 may be implemented by an optical sensor (e.g., a photocoupler), a magnetic sensor that detects magnetism by using a hall effect, an electric resistance sensor that detects changes in electric resistance, and/or a switch that generates a signal according to a physical contact.

Because at least a portion of the handle 110 is arranged to be exposed to the outside of the case 7, the user may manually rotates the handle 110. In this case, the user's force may be transmitted to the gear surface 20*g* through the force transmission unit 113 so that the second cartridge 20 may rotate.

In a state in which the position of at least one of the chambers 21 of the second cartridge 20 corresponds to the position of the delivery hole 11 of the first cartridge 10, the user may inhale the aerosol through the mouthpiece 26.

While the second cartridge 20 is rotated, the controller 70 may identify the usage chamber that is aligned with the delivery hole 11 (i.e., a chamber that is in use to pass the aerosol) among the chambers 21, based on the signal from the position sensor 120.

The controller 70 may output and provide information about the usage chamber that is currently aligned with the position of the delivery hole 11 to the user through an information generator.

When manipulating the handle 110 to rotate the second cartridge 20, the user may simultaneously check the information about the usage chamber output by the information generator and then may select a desired chamber to be used among the chambers 21.

Embodiments are not limited by the connection structure shown in FIG. 14 of the handle 110 for moving the second cartridge 20 and the second cartridge 20, and the structure of the handle 110 that may be manually operated by the user and the connection structure of the handle 110 and the second cartridge 20 may be variously changed. For example, the handle 110 may not be directly connected to the gear surface 20*g* of the second cartridge 20. Instead, an additional transmission element such as a rubber ring or a ring having a transmission gear may be installed to transmit force between the handle 110 and the second cartridge 20. In another embodiment, a handle 110 may be installed on an outer surface of the second cartridge 20.

If the handle 110 is directly connected to the second cartridge 20 or the handle 110 is installed on the second cartridge 20, the switch for generating the position signal indicating the position of the chambers 21 according to changes in the rotation position of the second cartridge 20 may be installed at the handle 110.

Figure 15:
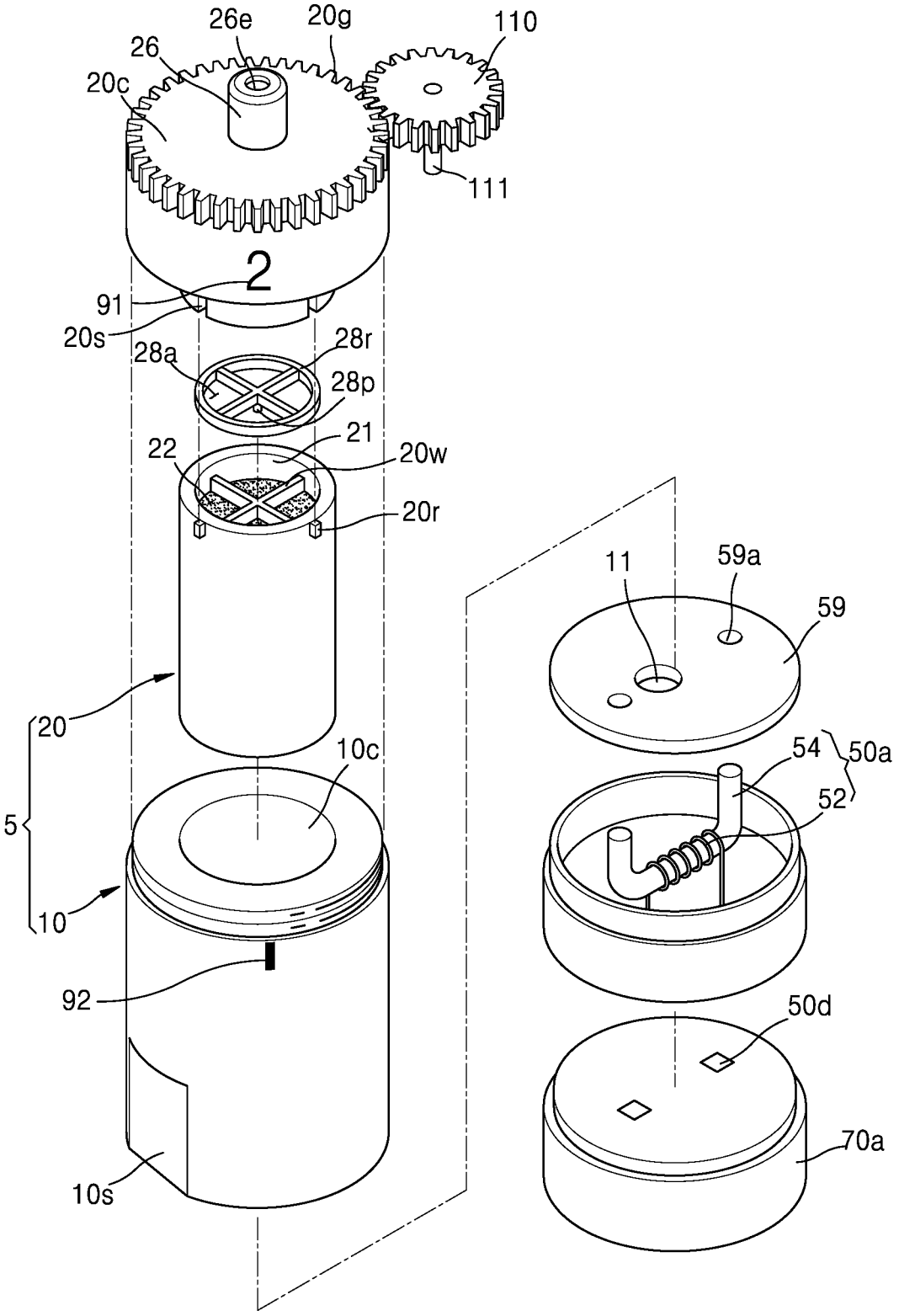
FIG. 15 is an exploded view schematically illustrating a coupling relationship between components of an aerosol delivering device according to another embodiment.
Figure 16:
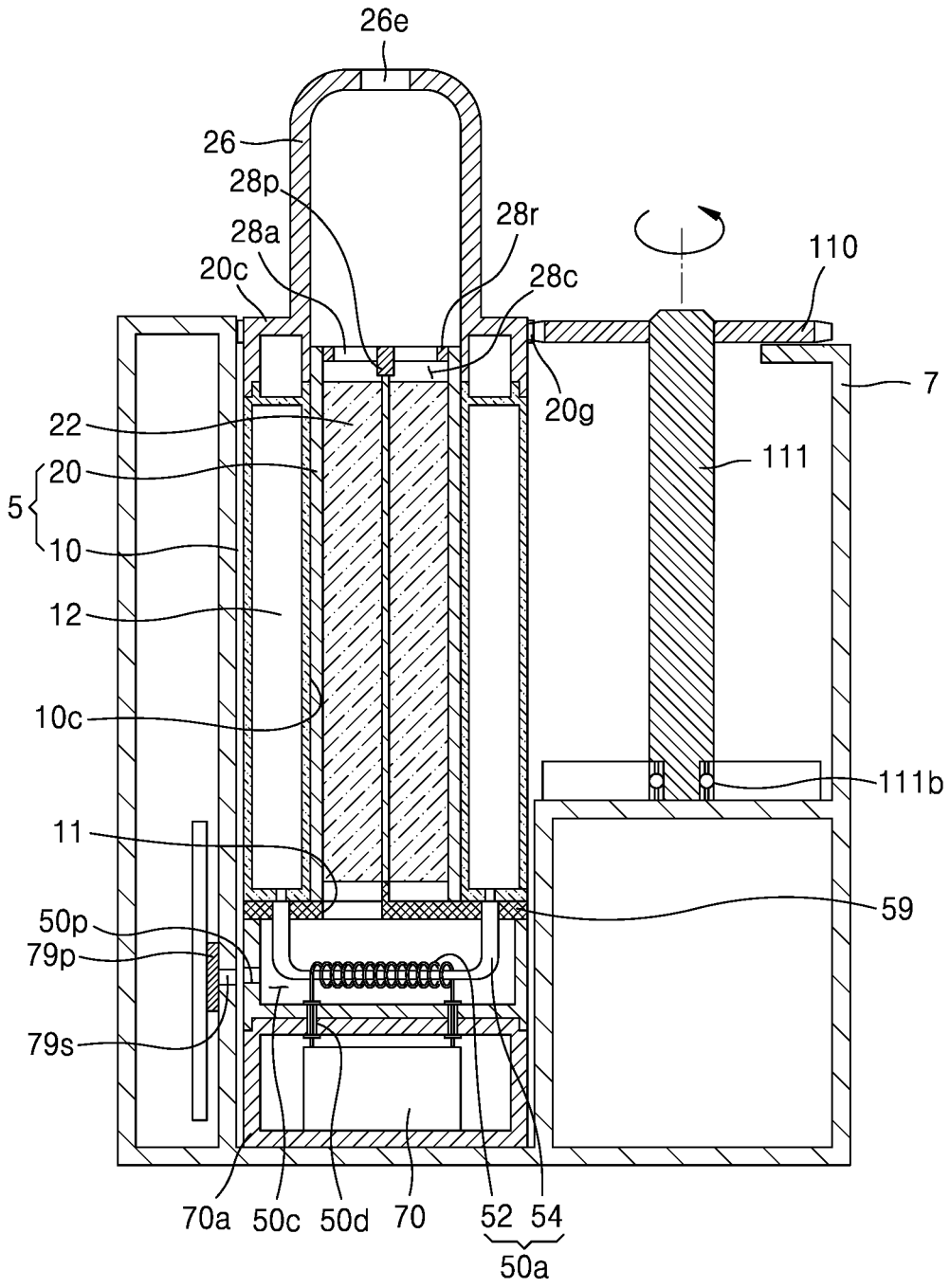
FIG. 16 is a longitudinal cross-sectional view of an aerosol generating device including the aerosol delivering device according to the embodiment shown in FIG. 15.

FIG. 15 is an exploded view schematically illustrating a coupling relationship between components of an aerosol delivering device according to another embodiment, and FIG. 16 is a longitudinal cross-sectional view of an aerosol generating device including the aerosol delivering device according to the embodiment shown in FIG. 15.

The aerosol generating device according to the embodiment shown in FIGS. 15 and 16 may include an aerosol delivering device 5 for supplying an aerosol to a user, and an atomizer 50*a* connected to the aerosol delivering device 5. The aerosol generating device may further include a main body 70*a* detachably connectable to the atomizer 50*a*.

The aerosol delivering device 5 may include a first cartridge 10 for accommodating the first material 12 for generating an aerosol, and a second cartridge 20 located inside the first cartridge 10 to be rotated with respect to the first cartridge 10.

The first cartridge 10 of the aerosol delivering device 5 may be connected to the atomizer 50*a* and may supply the first material 12 to the atomizer 50*a*. The aerosol generated from the atomizer 50*a* may be delivered to the second cartridge 20 via the delivery hole 11.

The first cartridge 10 may include a support hole 10*c* inside to accommodate the second cartridge 20. The support hole 10*c* may extend in the longitudinal direction of the first cartridge 10. The second cartridge 20 may be rotated with respect to the first cartridge 10 based on a longitudinal central axis of the support hole 10*c* in a state where the second cartridge 20 is inserted into the support hole 10*c* of the first cartridge 10.

The first cartridge 10 may accommodate the second cartridge 20 inside, thereby rotatably supporting the second cartridge 20 and protecting the second cartridge 20. Because the inside of the first cartridge 10 is empty, the first cartridge 10 may accommodate the first material 12.

The second cartridge 20 may accommodate the second material 22 through which the aerosol delivered from the atomizer 50*a* may pass and may be discharged to the outside. The second cartridge 20 may include a plurality of chambers 21 which are separated from each other by a barrier wall 20*w*, and the second material 22 may be accommodated in each of the chambers 21. The plurality of chambers 21 of the second cartridge 20 may be sequentially arranged in the rotation direction of the second cartridge 20.

An intermediate sheet 28*r* including a plurality of discharge holes 28*a* formed to respectively correspond to the plurality of chambers 21 may be coupled to the upper opening of the second cartridge 20. An upper support body 20*c* may be coupled to the upper end of the second cartridge 20. A mouthpiece 26 including an outlet 26*e* for discharging an aerosol to the outside may be formed on a top surface of the upper support body 20*c*. A spacer projection 28*p* protruding toward the upper opening of the second cartridge 20 may be arranged on a lower portion of the intermediate sheet 28*r*.

Referring to FIG. 16, when the intermediate sheet 28*r* is coupled to the upper opening of the second cartridge 20, the intermediate sheet 28*r* and the top end of the second material 22 accommodated in the second cartridge 20 are apart from each other. Accordingly, a chamber 28*c* in which an aerosol may stay may be formed between the intermediate sheet 28*r* and the top end of the second material 22. Because the aerosol passing through the second material 22 of the second cartridge 20 and moving to the top end of the second cartridge 20 collects in the chamber 28*c*, a sufficient pressure by the aerosol may be formed in the chamber 28*c*. The chamber 28*c* may be formed in an intermediate region on a path through which the aerosol that has passed through the second cartridge 20 is delivered to the mouthpiece 26, thereby performing the function of damping and/or regulating the pressure of the aerosol discharged to the mouthpiece 26.

A coupling projection 20*r* may protrude from an outer circumferential surface of a top end of the second cartridge 20, and a coupling groove 20*s* into which the coupling projection 20*r* may be inserted, may be formed in a bottom surface of the upper support body 20*c*. The mark 91 may be arranged on the outer surface of the upper support body 20*c*. Because the coupling protrusion 20*r* needs to be inserted into the coupling groove 20*s* so that the second cartridge 20 and the upper support body 20*c* may be coupled to each other, the second cartridge 20 and the upper support body 20*c* may be coupled to each other at pre-set coupling positions. Also, the upper support body 20*c* and the second cartridge 20 may be rotated together in a state where the coupling protrusion 20*r* is inserted into the coupling groove 20*s*.

A mark 92 that may be used as a reference position with respect to the mark 91 of the second cartridge 20 may be located outside the first cartridge 10. The user may rotate the second cartridge 20 with respect to the first cartridge 10 so that the mark 91 of the second cartridge 20 may coincide with the mark 92 of the first cartridge 10. In this way, the position of at least one of the chambers 21 of the second cartridge 20 may be aligned with the position of the delivery hole 11 through which the aerosol is discharged.

In addition, a position fixing surface 10*s* may be formed in a partial region of the outside of the first cartridge 10. The position fixing surface 10*s* may perform an alignment function of aligning the relative position of the aerosol delivering device 5 with respect to the case 7 when the aerosol delivering device 5 is inserted into the case 7, and the function of preventing the rotational motion of the first cartridge 10 while the second cartridge 20 is rotated.

A gear surface 20*g* may be arranged outside the upper support body 20*c* of the second cartridge 20 and may extend in the rotation direction of the second cartridge 20. A gear of a handle 110 that may be manually operated by the user may engage with the gear surface 20*g*. Referring to FIG. 16, a bottom end of a handle shaft 111 connected to the handle 110 may be rotatable coupled to the case 7 by a bearing 111*b*. A force applied the handle 110 may be transmitted to the upper support body 20*c* through the gear surface 20*g* so that the upper support, body 20*c* and the second cartridge 20 may make a rotational motion.

The atomizer 50*a* may include a wick 54 that absorbs and holds the first material 12 from a lower portion of the first cartridge 10, and a heater 52 may be wound on the wick 54 or may be disposed adjacent to the wick 54 to heat the first material 12 to generate an aerosol.

The heater 52 may be an electric resistive heating element that is connected to the electrical terminal 50*d* inside the case 7 and may generate heat by electricity supplied from the controller 70.

The atomizer 50*a* may perform the function of generating an aerosol from the first material 12 and delivering the aerosol to the second cartridge 20. A sealing plate 59 may be arranged between the bottom end of the first cartridge 10 and the atomizer 50*a*, The sealing plate 59 may perform the function of sealing the upper opening of the atomizer 50*a* to form a space for generating an aerosol together with the atomizer 50*a* and sealing the bottom end of the first cartridge 10. The sealing plate 59 may include a supply hole 59*a* for supplying the first material 12 of the first cartridge 10 to the wick 54, and a delivery hole 11 for delivering the aerosol generated in the atomizer 50*a* to the second cartridge 20.

The delivery hole 11 may be located to correspond to a support hole 10*c* inside the first cartridge 10. After the aerosol generated in the atomizer 50*a* passes through the delivery hole 11, the aerosol may move in a longitudinal direction of the first cartridge 10 in the first cartridge 10 along the support hole 10*c*.

Referring to FIG. 16, a puff sensor 79*p* may be arranged on a flow path of the aerosol inside the case 7. The puff sensor 79*p* may detect the user's aerosol inhalation based on the flow of the aerosol. For example, the puff sensor 79*p* may be connected to the inner space of the atomizer 50*a*, detect the change in pressure or flow rate of air (i.e., mainstream including an aerosol) flowing through the inside of the atomizer 50*a*, and generate a signal based on the detected change. The puff sensor 79*p* may be arranged in a pressure detection hole 79*s* connected to the delivery passage 50*p* of the atomizer 50*a*.

In the aerosol generating device described above, the aerosol delivered from the atomizer 50*a* and entering the chambers 21 of the second cartridge 20 may pass through the second material 22 accommodated in the chambers 21. The second material 22 may provide flavors to the aerosol. As a result, the aerosol that has passed through the second material 22 may have sufficient flavors and may be discharged to the outside of the aerosol generating device through the mouthpiece 26.

Figure 17:
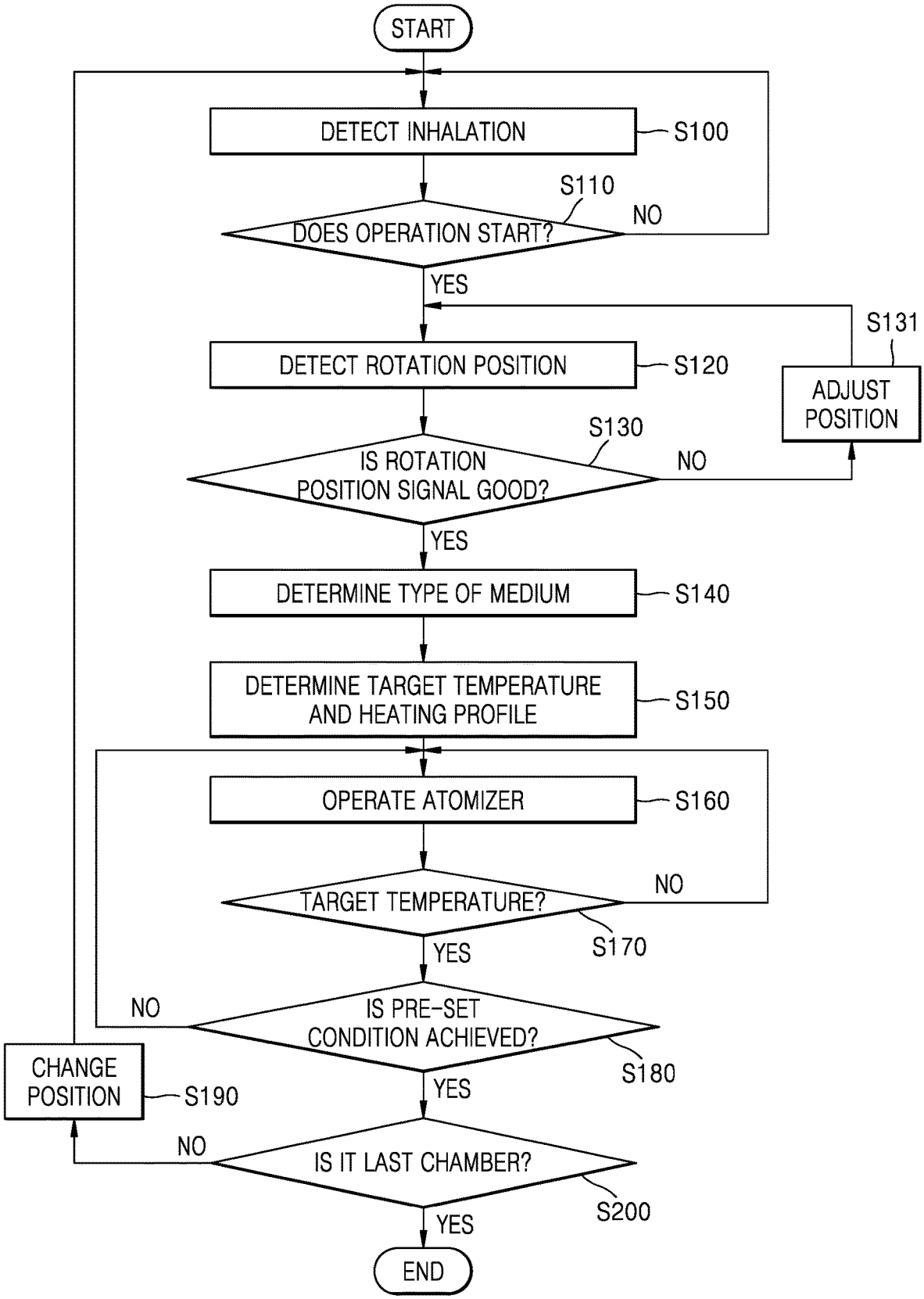
FIG. 17 is a flowchart schematically illustrating a method of generating an aerosol by using the aerosol generating device according to the embodiments shown in FIGS. 6 through 16.

FIG. 17 is a flowchart schematically illustrating a method of generating an aerosol by using the aerosol generating device according to the embodiments shown in FIGS. 6 through 16.

The method of generating an aerosol according to the embodiment shown in FIG. 17 may include detecting a user's inhalation operation (S100), determining that the inhalation operation has been detected to start an aerosol-supplying operation (S110), detecting a rotation position of the second cartridge with respect to the first cartridge (S120), determining whether a signal of the detected rotation position of the second cartridge is good (S130), when the signal of the rotation position is not good, adjusting the rotation position of the second cartridge (S131), when the signal of the rotation position of the second cartridge is good, determining the type of a medium currently in use to supply the aerosol (i.e., determining the type of a second material) based on the signal of the rotation position of the second cartridge (S140), determining at least one of a target temperature for an operation of an atomizer and a heating profile for controlling a heating operation of the atomizer based on the determined type of the medium (S150), operating the atomizer based on the target temperature or the heating profile (S160), detecting a current temperature to compare the current temperature with the target temperature (S170), comparing whether a pre-set condition is achieved (S180), when the pre-set condition is achieved, checking whether a current usage chamber is a last chamber among chambers of the second cartridge (S200), and when the current usage chamber is not the last chamber, changing relative positions of the first cartridge and the second cartridge (S190).

A pre-set condition for changing the relative positions of the first cartridge and the second cartridge may include a cumulative time of heating operations of a heater and/or the heating temperature of the heater.

Alternatively, the pre-set condition for changing the relative positions of the first cartridge and the second cartridge may include the number of puffs and/or the cumulative time of the puffs.

Alternatively, the pre-set condition for changing the relative positions of the first cartridge and the second cartridge may include a usage time determined based on an input signal generated when an input device receives the user's input.

By performing changing the relative positions of the first cartridge and the second cartridge (S190), a usage chamber through which the aerosol currently passes, among the chambers of the second cartridge may be changed. In other words, a subsequent chamber may be moved to a position corresponding to a delivery hole of the first cartridge. The changing of the relative positions of the first cartridge and the second cartridge (S190) may be automatically performed by a driving device operated by a controller or by the user's manual manipulation.

The changing of the relative positions of the first cartridge and the second cartridge (S190) may include, when the pre-set condition is met, providing a notification of the need to change positions of the chambers to the user, receiving an input signal generated when the user manipulates the input device, providing information about a chamber aligned with a delivery hole of the first cartridge among the chambers of the second cartridge to the user, and changing the position of at least one of the first cartridge and the second cartridge by operating the driving device based on input manipulation received from the input device.

When the relative positions of the first cartridge and the second cartridge are changed, the usage chamber may be immediately moved out of the position corresponding to the delivery hole, the subsequent chamber may be aligned with the delivery hole such that the aerosol may pass through the subsequent chamber. Alternatively, the usage chamber and the subsequent chamber may perform an operation of passing the aerosol temporarily together for a while, and as time passes, only the subsequent chamber may perform the operation of passing the aerosol.

After the changing of the relative positions of the first cartridge and the second cartridge (S190), the method returns to detecting of the user's inhalation operation (100) such that the above-described operations may be repeated.

According to the embodiments, even when the first cartridge of the aerosol generating device is designed to accommodate a large amount of the first material, the second cartridge may be rotated to select another chamber for supplying an aerosol. Therefore, the second material may be replaced with a new material without replacing the second cartridge including the second material.

In addition, if the chambers of the second cartridge include different types of second materials, the user may select a chamber corresponding to a desired second material. In this respect, the user may freely enjoy an aerosol having various flavors according to the user's preference.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

INDUSTRIAL APPLICABILITY

One or more embodiments relate to an aerosol delivering device and an aerosol generating device with the same.

The invention claimed is:

1. An aerosol generating device comprising:

an aerosol delivering device comprising:

a first cartridge configured to accommodate a first material for generating an aerosol; and a second cartridge rotatably coupled to the first cartridge, configured to accommodate a second material and allow the aerosol generated from the first material to pass through the second material; and an atomizer connected to the first cartridge and configured to generate the aerosol by atomizing the first material and deliver the aerosol to the second cartridge, wherein the second cartridge is arranged outside the first cartridge such that the second cartridge surrounds the first cartridge, or the second cartridge is arranged inside the first cartridge such that the first cartridge surrounds the second cartridge.

2. The aerosol generating device of claim 1, wherein the second cartridge comprises a single chamber extending in a rotation direction of the second cartridge and configured to accommodate the second material.

3. The aerosol generating device of claim 1, wherein the second cartridge comprises a plurality of chambers sequentially arranged in a rotation direction of the second cartridge and configured to accommodate the second material.

4. The aerosol generating device of claim 3, further comprising a driving device configured to rotate the second cartridge, wherein the atomizer comprises a delivery hole through which the aerosol generated from the first material is delivered to the second cartridge, and the second cartridge is rotated by the driving device such that the aerosol delivered from the delivery hole passes through at least one of the chambers of the second cartridge.

5. The aerosol generating device of claim 4, wherein a relative position of the second cartridge with respect to the first cartridge is changed such that a position of one of the chambers is aligned with a position of the delivery hole.

6. The aerosol generating device of claim 4, wherein a relative position of the second cartridge with respect to the first cartridge is changed such that adjacent chambers from among the chambers simultaneously overlap the delivery hole.

7. The aerosol generating device of claim 1, wherein the atomizer is detachably coupled to the aerosol delivering device and configured to atomize the first material supplied from the first cartridge to generate the aerosol, and the atomizer comprises a delivery hole through which the aerosol is delivered to the second cartridge.

8. The aerosol generating device of claim 1, further comprising:

a driving device configured to rotate the second cartridge with respect to the first cartridge; and a controller configured to change a relative position of the second cartridge with respect to the first cartridge.

9. The aerosol generating device of claim 8, further comprising a position sensor configured to detect the relative position of the second cartridge with respect to the first cartridge.

10. The aerosol generating device of claim 1, further comprising a handle that is operable by a user and configured to change a relative position of the second cartridge with respect to the first cartridge.

11. The aerosol generating device of claim 1, wherein the atomizer comprises:

a delivery body made of a porous material configured to absorb and hold the first material of the first cartridge; and a heater printed on the delivery body or formed integrally with the delivery body and configured to generate heat.

12. An aerosol delivering device comprising:

a first cartridge configured to accommodate a first material for generating an aerosol; and a second cartridge rotatably coupled to the first cartridge, and configured to accommodate a second material and allow the aerosol generated from the first material to pass through the second material, wherein the second cartridge is arranged outside the first cartridge such that the second cartridge surrounds the first cartridge, or the second cartridge is arranged inside the first cartridge such that the first cartridge surrounds the second cartridge.

13. The aerosol delivering device of claim 12, wherein the second cartridge comprises a single chamber extending in a rotation direction of the second cartridge and configured to accommodate the second material.

14. The aerosol delivering device of claim 12, wherein the second cartridge comprises a plurality of chambers sequentially arranged in a rotation direction of the second cartridge and configured to accommodate the second material.

15. The aerosol delivering device of claim 12, wherein at least a portion of the first cartridge comprises a transparent material such that a remaining amount of the first material is viewable through the transparent material, and the second cartridge comprises a transparent window through which the transparent material of the first cartridge is viewable from outside of the second cartridge.

* * * * *